US006371598B1

(12) United States Patent
Fujii et al.

(10) Patent No.: US 6,371,598 B1
(45) **Date of Patent: *Apr. 16, 2002**

(54) INK JET RECORDING APPARATUS, AND AN INK JET HEAD

(75) Inventors: Masahiro Fujii, Shiojiri; Shigeo Nojima, Suwa; Taro Takekoshi; Hiroyuki Ishikawa, both of Shiojiri, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/168,222

(22) Filed: Oct. 7, 1998

Related U.S. Application Data

(63) Continuation-in-part of application No. 08/424,929, filed on Apr. 19, 1995.

(30) Foreign Application Priority Data

| | | |
|---|---|---|
| Apr. 20, 1994 | (JP) | 6-81899 |
| Apr. 20, 1994 | (JP) | 6-81900 |
| Oct. 9, 1998 | (JP) | 9-277268 |

(51) Int. Cl.[7] ..... B41J 2/04
(52) U.S. Cl. ..... 347/54
(58) Field of Search ..... 438/53; 347/94, 347/54, 68, 20

(56) References Cited

U.S. PATENT DOCUMENTS

| | | | | |
|---|---|---|---|---|
| 3,929,071 | A | 12/1975 | Cialone et al. | 347/89 |
| 4,124,853 | A | 11/1978 | Kattner et al. | 347/94 |
| 4,158,847 | A | 6/1979 | Heinzl | 347/93 |
| 4,346,388 | A | 8/1982 | Wiley | 347/93 |
| 4,380,770 | A | 4/1983 | Maruyama | 347/93 |
| 4,571,599 | A | 2/1986 | Rezanka | 347/87 |
| 4,630,072 | A | 12/1986 | Scardovi et al. | 347/94 |
| 4,697,193 | A | 9/1987 | Howkins | 347/370 |
| 4,730,197 | A | 3/1988 | Raman et al. | 347/94 |
| 4,777,497 | A | 10/1988 | Nozu et al. | 347/94 |
| 5,124,717 | A | 6/1992 | Campanelli et al. | 347/67 |
| 5,177,504 | A | 1/1993 | Ishii et al. | 347/68 |
| 5,510,816 | A | 4/1996 | Hosono et al. | 347/70 |
| 5,513,431 | A | 5/1996 | Ohno et al. | 347/54 |
| 5,534,900 | A | 7/1996 | Ohno et al. | 347/54 |
| 5,563,634 | A | 10/1996 | Fujii et al. | 347/54 |
| 5,644,341 | A | 7/1997 | Fujii et al. | 347/54 |
| 5,646,662 | A | 7/1997 | Kitahara. | 347/47 |
| 5,668,579 | A | 9/1997 | Fujii et al. | 347/54 |
| 5,699,093 | A | 12/1997 | Alderson | 347/94 |
| 5,734,395 | A | 3/1998 | Kamisuki et al. | 347/59 |
| 5,754,204 | A | 5/1998 | Kitahara | 347/70 |
| 5,896,150 | A | 4/1999 | Kobayashi et al. | 347/54 |
| 6,213,590 | B1 * | 4/2001 | Fujii et al. | 347/54 |

FOREIGN PATENT DOCUMENTS

| | | | |
|---|---|---|---|
| EP | 479 441 A3 | 4/1992 | B41J/2/14 |
| EP | 500 068 A3 | 8/1992 | B41J/2/175 |
| EP | 0 580283 | 1/1994 | B41J/2/16 |
| JP | 62-8316 | 2/1987 | G11B/5/265 |
| JP | 1 186331 | 7/1989 | B41J/3/04 |
| JP | 2-59769 | 12/1990 | B41J/2/175 |
| JP | 4 345853 | 12/1992 | B41J/3/04 |

* cited by examiner

*Primary Examiner*—John Barlow
*Assistant Examiner*—Charles W. Stewart, Jr.

(57) ABSTRACT

An ink jet head that prevents pressure interference between nozzles without incurring an increase in size is provided. A pressure change buffer is provided for preventing pressure interference in this ink jet head can also be easily formed with the desired characteristics. An ink reservoir 1010, orifice 1008, and ejection chambers 1006 are formed in a horizontal arrangement between the nozzle plate 1002 and cavity plate 1003 of this ink jet head 1001. Pressure change buffer 1022 for buffering pressure change in the ink reservoir 1010 is formed in a first wall 1010*b*, which is part of the wall determining the shape of the ink reservoir 1010. It is therefore possible to prevent pressure interference between nozzles without incurring an increase in size. In addition, the pressure change buffer 1022 can be easily formed with the desired operating characteristics.

35 Claims, 23 Drawing Sheets

$$Ra = \frac{2n}{n} \int_0^l \frac{T^2(x)}{S^3(x)}\, dx$$

$$Ma = \frac{P}{n} \int_0^l \frac{1}{S(x)}\, dx$$

$$Mf = \frac{PLf}{Sf}$$

$$Rf = \frac{2nTf^2}{S^3 f}$$

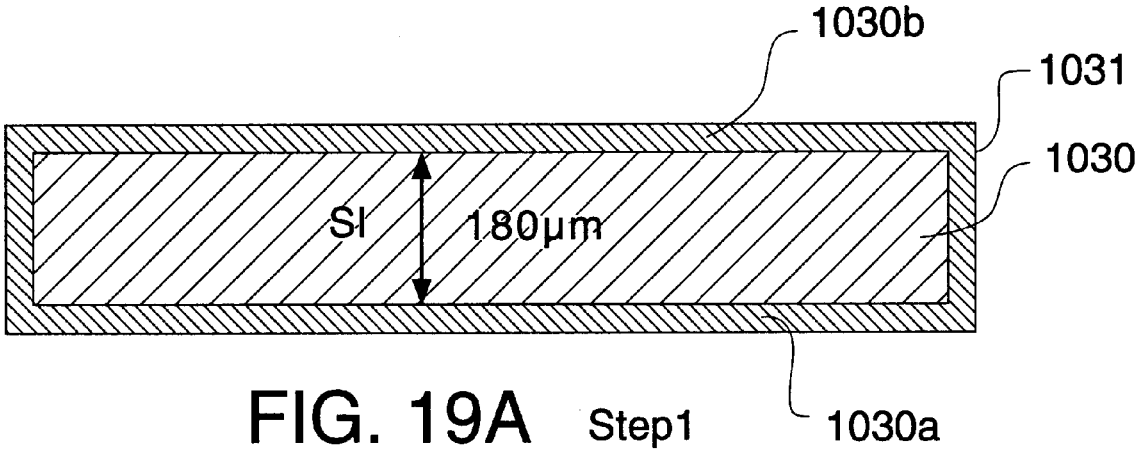
FIG. 19A Step1
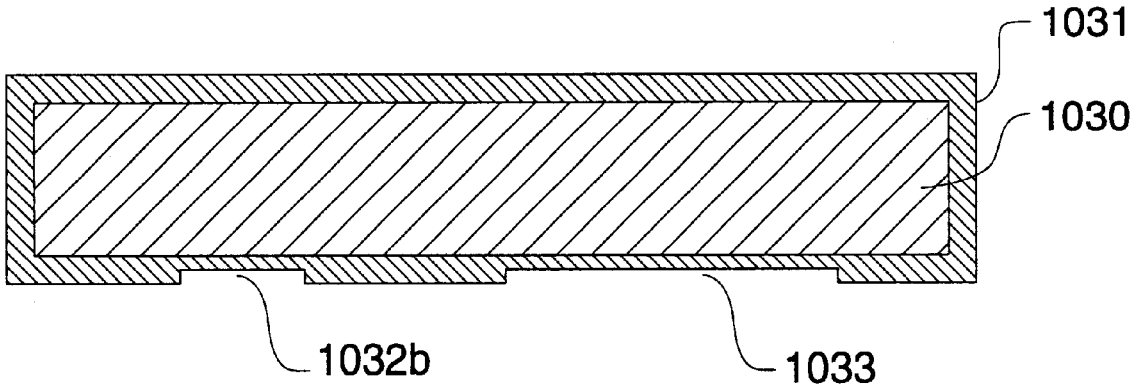
FIG. 19B Step2
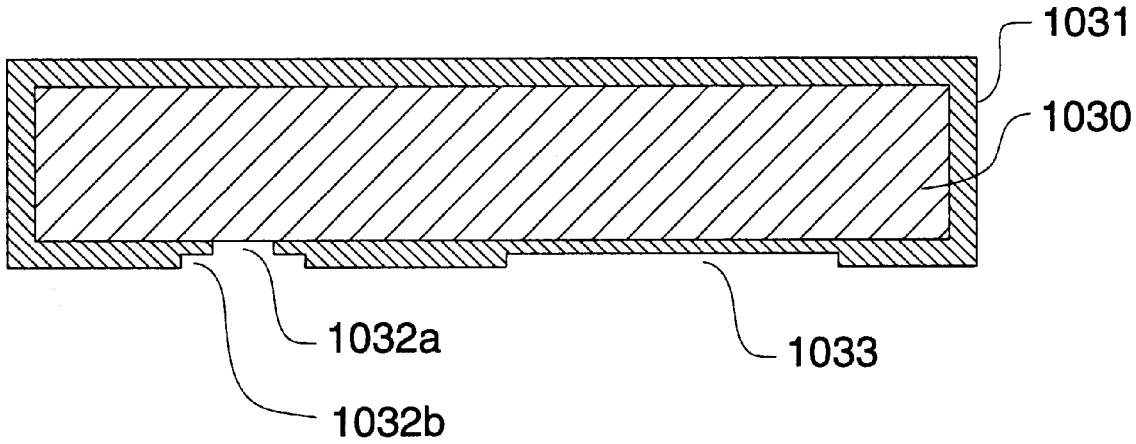
FIG. 19C Step3

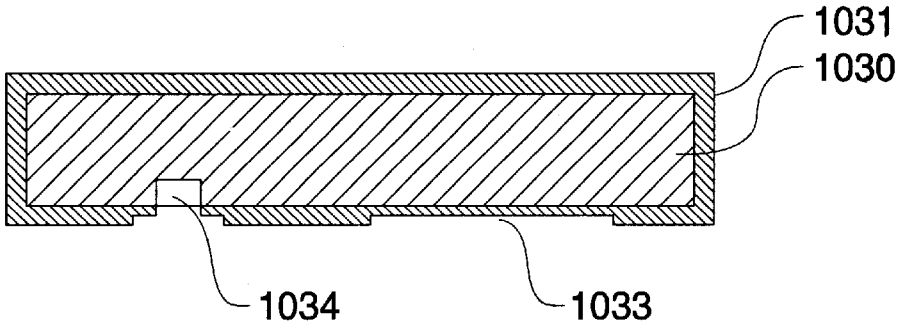
FIG. 20A Step4
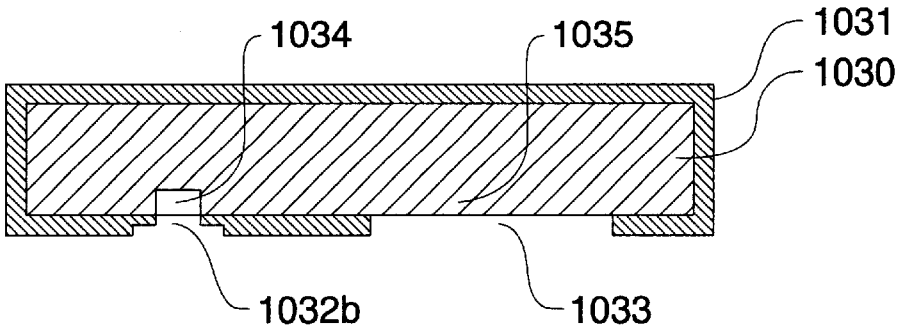
FIG. 20B
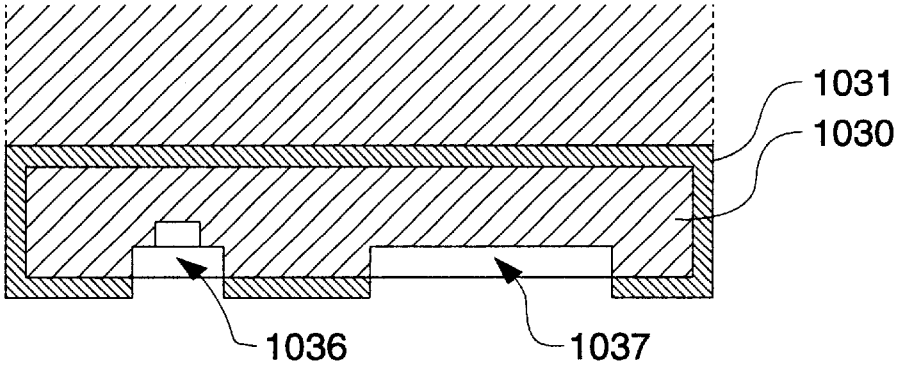
FIG. 20C Step5
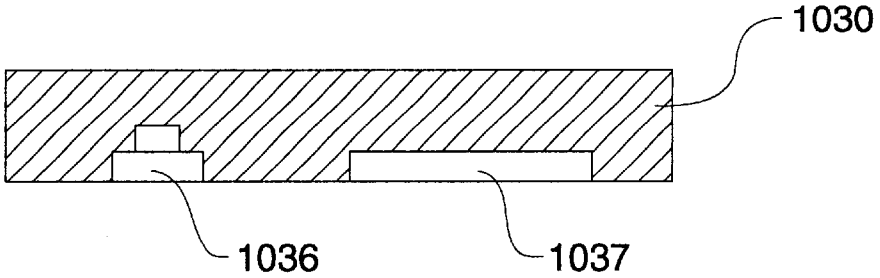
FIG. 20D FIG. 21A Step6
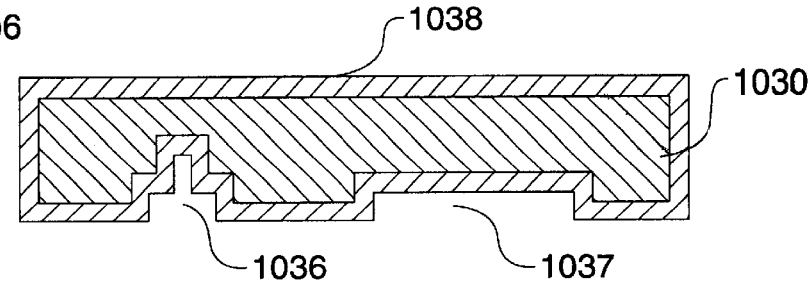
FIG. 21B Step7
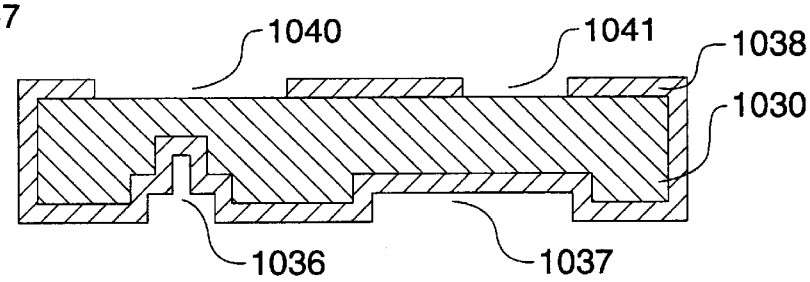
FIG. 21C Step8
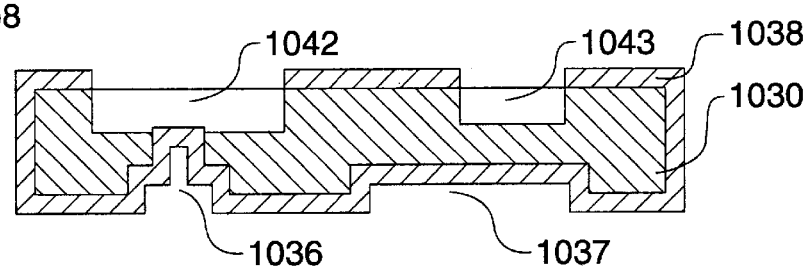
FIG. 21D
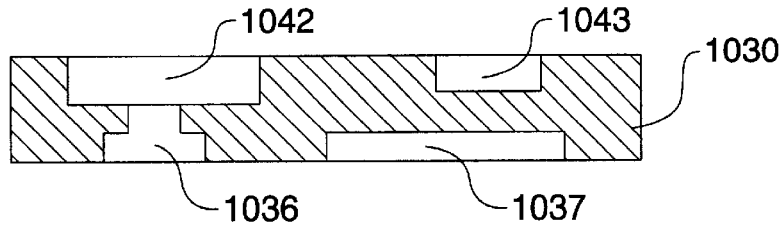
FIG. 22
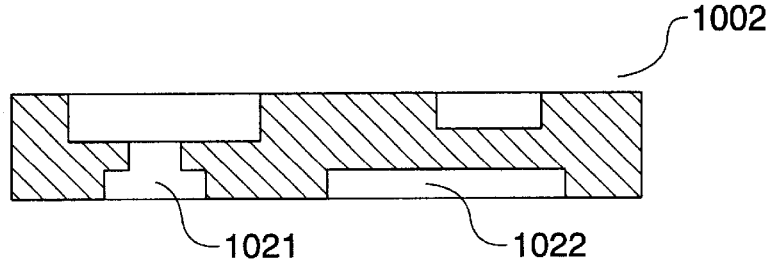

INK JET RECORDING APPARATUS, AND AN INK JET HEAD

CONTINUING APPLICATION DATA

This application is a continuation-in-part of application Ser. No. 08/424,929 filed Apr. 19, 1995, the contents of which are incorporated herein by reference.

CROSS REFERENCE TO RELATED APPLICATIONS

This application is related to the following commonly-assigned, applications:

"Ink-Jet Recording Apparatus and Method for Producing the Head Thereof," Ser. No. 07/757,691, filed on Sep. 11, 1991 by Yoshihiro Ohno, et al., now U.S. Pat. No. 5,534,900 which issued on Jul. 9, 1996.

"Ink-Jet Recording Apparatus and Method for Producing the Head Thereof," Ser. No. 08/259,554, filed on Jun. 14, 1994 by Yoshihiro Ohno, et al., now U.S. Pat. No. 5,513,431 which issued on May 7, 1996.

"Inkjet Head Drive Apparatus and Drive Method, and a Printer Using These," Ser. No. 08/274,184, filed on Jul. 12, 1994 by Masahiro Fujii, et al., now U.S. Pat. No. 5,563,634 which issued on October 8, 1996.

"Inkjet Head Drive Apparatus and Drive Method, and a Printer Using These," Ser. No. 08/350,912, filed on Dec. 7, 1994 by Masahiro Fujii, et al., now U.S. Pat. No. 5,644,341 which issued on Jul. 1, 1997.

"Ink-Jet Printer and Its Control Method," Ser. No. 08/259,656, filed on Jun. 14, 1994 by Masahiro Fujii, et al., now U.S. Pat. No. 5,668,579 which issued on Sep. 16, 1997.

"Ink Jet Recording Apparatus", Ser. No. 08/477,681, filed on Jun. 7, 1995 by Mitsuro Atobe, et al.

"Method For Producing The Head Of An Ink Jet Recording Apparatus", Ser. No. 09/099,483, filed Jun. 17, 1998 by Mitsuro Atobe, et al.

"A Method For Producing an Electrostatic Actuator and an Inkjet Head Using It," Ser. No. 08/400,648 filed on Mar. 8, 1995, by Masahiro Fujii, et al.

"An Inkjet Recording Apparatus, Ser. No. 08/795,413 filed on Feb. 3, 1997 by Masahiro Fujii, et al.

BACKGROUND OF THE INVENTION

1. Field of the Invention

The present invention relates to an ink jet head for an ink jet printer, and relates more particularly to an ink jet head wherein pressure interference between ink nozzles can be prevented.

2. Description of the Related Art

Ink jet heads can be constructed using various means of ejecting ink droplets from the ink jet nozzles. One type of ink jet head, for example, uses a heater to make the ink bubble such that the resulting pressure from the air bubbles causes ink droplets to be ejected. Another mechanism uses a piezoelectric device attached to an ejection chamber in which ink is stored. In this mechanism a voltage applied to the piezoelectric device causes the ejection chamber to expand and contract, producing a pressure change whereby ink droplets are forced from a nozzle. Yet another mechanism uses electrostatic force to change the volume of the ink chamber in which ink is stored, again generating a pressure change whereby an ink droplet is expelled. Each of these mechanisms results in a so-called "ink-on-demand" ink jet head in which a change in the pressure of an ejection chamber is used to expel an ink droplet when required for printing.

In general, ink-on-demand ink jet heads have a plurality of ejection chambers each corresponding to one of a plurality of nozzles, an ink reservoir (common ink chamber) from which ink is supplied to each ejection chamber, and a nozzle linking each ejection chamber to the ink reservoir. As described above, a pressure change in an ejection chamber causes an ink droplet to be expelled from the corresponding nozzle. The ejection chambers, ink reservoir, and nozzles are formed by laminating plural flat substrates together with the substrate surfaces being appropriately etched to form the various grooves and recesses that become the ejection chambers, ink reservoir, and nozzles.

When a pressure change is effected in an ejection chamber to expel an ink droplet, the resulting pressure (ejection pressure) is transmitted to the ink reservoir. When a pressure change thus occurs in the ink reservoir, pressure interference between nozzles can occur through the ink reservoir. This can cause the ejected ink droplet volume to vary, and can cause ink to leak from nozzles (undriven nozzles) other than the nozzles (driven nozzles) from which ink is supposed to eject. For example, if a positive pressure occurs in the ink reservoir, ink droplets can leak from undriven nozzles. A negative pressure can cause the ink droplet volume from the driven nozzles to drop.

To avoid these problems, Japanese Examined Patent Publication (kokoku) HEI2-59769 teaches a unit called an ink distributor comprising a diaphragm for buffering the impact of pressure changes. When this unit is assembled with a nozzle part, the diaphragm suppresses pressure changes in the ink reservoir. As a result, the desired ink ejection characteristic can be obtained.

As printers have become smaller, however, demand has grown for even smaller, thinner ink jet heads. Unfortunately, the ink distributor used to achieve desired ink ejection characteristics as taught by the above-cited prior art is an additional structural component of the ink jet head. It thus increases the size of the ink jet head, and obviously prevents reducing the ink jet head size.

There is therefore a need for an ink jet head whereby pressure interference between nozzles can be prevented without increasing the size of the ink jet head.

There is a further need for an ink jet head wherein a diaphragm providing the desired pressure interference prevention can be easily achieved while retaining the desired printing characteristics.

OBJECTS OF THE INVENTION

Accordingly, it is an object of the present invention to provide an ink jet recording head which overcomes the aforementioned problems.

It is another object of the present invention to provide an ink jet recording apparatus having an ink jet head in which pressure interference between nozzles can be prevented without increasing the size of the ink jet head.

It is an additional object of the invention to provide an ink jet head in which a diaphragm providing the desired pressure interference prevention can be easily achieved while retaining the desired printing characteristics.

SUMMARY OF THE INVENTION

To achieve the aforementioned object, an ink jet recording apparatus according to the present invention comprises an ink jet head having a plurality of nozzle openings and a plurality of independent ejection chambers respectively communicating to each of said nozzle openings from which ink droplets are ejected according to the change in pressure generated by each ejection chamber. The apparatus further includes an ink cavity for storing ink, ink supplying paths which supply ink to each of the ejection chambers from the ink cavity and a filter formed in or attached to the ink cavity. The ejection chambers, the ink supplying paths, the ink cavity and the filter are formed together on an anisotropic crystalline substrate, such as a silicon substrate, and the filter has a plurality of channels, which are shallower than any of the other channels of the nozzles and ink supplying paths.

The filter is provided for preventing the introduction of foreign particulate to the ink chamber and to the nozzles. The filter also functions as inlet ports for supplying ink from an external source to the ink cavity.

The preferred shape of the filter is a cross-sectional area of the filter opening that is smaller than the cross-sectional area of the ink supply paths and the nozzles. In addition, the inertance of the filter is preferably a maximum one-fifth the inertance of the ink passage consisting of the ejection chambers and the ink supplying paths plus the corresponding nozzles; and the flow resistance of the filter is preferably a maximum one-fourth the flow resistance consisting of the ejection chambers and the ink supplying paths plus the corresponding nozzles. At least one wall of the ink cavity is also preferably flexible.

A method for producing an ink jet head according to the present invention comprises at least the step of anisotropically etching an anisotropic crystalline substrate on a first surface thereof to form at least a plurality of communicating channels delineating a plurality of independent ejection chambers, an ink cavity, a plurality of ink paths each connecting a respective ejection chamber with the ink cavity, and a filter connected to the ink cavity. Next, by means of anisotropic etching, a group of adjacently disposed grooves with said filter is formed, each of which is shallower than the channels delineating the ejection chambers, the ink cavity and the ink paths, and nozzle openings each of which connects with each of the ejection chambers. Forming, by means of anisotropic etching, a plurality of diaphragms with each of the bottom walls of said ejection chambers and bonding a cover substrate to the first surface of the anisotropic crystalline substrate sealing the rims of ejection chambers, the ink cavity, the ink paths and the filter to enclose the same while maintaining the communication therebetween.

To form the actuator for driving the diaphragm, this manufacturing method further comprises a process for forming electrodes in the first surface of an insulating substrate, and bonding the insulating substrate to the second surface of the anisotropic crystalline substrate on the side opposite the first face thereof such that the electrodes are in opposition to the diaphragms with a gap therebetween. Alternatively, a process for adhesive bonding piezoelectric elements for deforming the diaphragms to the back side of the ejection chambers of the anisotropic crystalline substrate is provided.

By means of the invention thus described, ink supplied to the ink jet head is supplied through a filter disposed in the ink supply port and is stored in the ink cavity. The ink stored in the ink cavity is distributed through the ink supply paths to the respective ejection chambers. The pressure generating means is then driven according to the print data, thereby pressurizing the ink in the ejection chamber, and causing an ink drop to be ejected from the nozzle continuous to the pressurized ejection chamber.

Because the ink and cleaning solution used to clean the ink supply path during manufacture is supplied through the filter disposed in the ink supply port, foreign particulate larger than the cross-sectional area of the filter opening and suspended in the ink or cleaning solution is stopped from entering the ink supply paths by the filter, and is thus prevented from penetrating to the ink supply path downstream from the ink supply port. Any foreign particulate passing the filter can therefore be ejected from the nozzle because the cross-sectional area of the filter opening is less than the cross-sectional area of the nozzle opening and ink supply path, and clogging of the narrow nozzles is thus eliminated. Printing problems are thus eliminated because clogging of the ink passage is prevented, and a high reliability ink jet head can be obtained.

The pressure increase in the ink chamber caused by the pressure generated in the ejection chamber of the driven nozzles is also reduced because the filter inertance is preferably a maximum one-fifth the inertance of the ink passage from the nozzle to the supply port. The problems of pressure, more specifically pressure interference and cross talk between ejection chambers, produced by the driven nozzle transferring to a non-driven nozzle and causing ink to be ejected from the non-driven nozzle are thus eliminated.

In addition, sufficient ink can be supplied from the ink supply port to the ink passage downstream therefrom because the flow resistance of the filter is preferably a maximum one-fourth the flow resistance of the ink passage from the head nozzles to the ink supply path. An ink supply deficiency therefore does not occur, printing density does not drop during high speed ink jet head drive, and such printing problems as dropped pixels caused by inconsistent ejecting do not occur.

In addition, if at least one wall of the ink chamber is flexible, pressure generated by the ejection chamber of the driven nozzle can be sufficiently buffered and reduced, thereby eliminating cross talk caused by pressure interference between ejection chambers.

In accordance with another aspect of the present invention an ink jet head is provided for ejecting ink droplets from a nozzle by means of; a common ink chamber; an ink supply opening for supplying ink to the common ink chamber; a plurality of nozzles; an ink path for connecting each nozzle to the common ink chamber; a pressure generator or a pressure generating means disposed in each ink path and selectively driven for ejecting an ink droplet from a corresponding nozzle; and a flexible wall defining part of a wall of the common ink chamber for buffering pressure change in the common ink chamber.

This flexible wall forms a pressure change buffering means, or diaphragm. It is therefore not necessary to provide a separate member such as an ink distributor to prevent pressure interference between nozzles, and an ink jet head that can prevent pressure interference between nozzles without incurring an increase in size can thus be provided.

When the ink paths and common ink chamber of the ink jet head are formed by laminating together a first substrate in which said nozzles are formed, and a second substrate in which a recess that becomes part of the common ink chamber and ink path is formed, the flexible wall can be formed in either the first or second substrate.

The characteristics of the pressure change buffer are determined by its thickness and area. To achieve the same characteristics, the thickness of the flexible wall can be increased if the wall area is large, but if the wall area is small, the wall must be made correspondingly thinner. If the flexible wall is too thin, it becomes easily damaged. Forming this wall can therefore be difficult depending on the wall thickness, and adjusting the wall characteristics (flexibility) can be difficult.

In an ink jet head according to the present invention, however, the flexible wall is formed as part of the common ink chamber, and a pressure change buffer with a large area can therefore be achieved. It is therefore easy to form a pressure change buffer for preventing pressure interference with the desired characteristics.

The flexible wall is further preferably formed so that the compliance of the common ink chamber is $1\times10^{-17}$ $m^5/N$ or greater. This assures that the pressure change buffer can sufficiently buffer pressure change in the common ink chamber.

When the pressure change buffer is disposed to the first substrate in which the nozzles are formed, that is, when the flexible wall is formed in the first substrate, it is externally exposed. In this case it is preferable to cover the flexible wall with a protective cover. However, if the flexible wall is completely covered the pressure change buffer becomes sealed, and adverse effects on the vibration of the pressure change buffer can result. In this case, therefore, it is preferable to provide a ventilation hole in the protective cover.

The pressure generator of this ink jet head can be operated by electrostatic force, that is, the ink jet head according to the present invention can be applied to an electrostatic drive type of ink jet head. It will also be obvious that the ink jet head according to the present invention can also be used with ink jet heads of the type that expel ink droplets using pressure from generated air bubbles, and with ink jet heads that are operated with piezoelectric elements.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

These and other objects and features of the present invention will be readily understood from the following detailed description taken in conjunction with preferred embodiments thereof with reference to the accompanying drawings, in which like parts are designated by like reference numerals and in which:.

FIGS. 11A–11D depict the process of the manufacturing method according to the present invention for forming the channels in substrate 1;

FIGS. 19A to 19C are drawings used to describe the manufacture of the nozzle plate of the ink jet head shown in FIG. 15, FIG. 19A showing a first thermal oxidation process, FIG. 19B showing a process for forming a first pattern on the $SiO_2$ resist film, and FIG. 19C showing a process for forming a second pattern on the $SiO_2$ resist film;

FIGS. 20A to 20D are further drawings used to describe the manufacture of the nozzle plate of the ink jet head shown in FIG. 15, FIG. 20A showing a first dry etching process of the silicon wafer, FIG. 20B showing the wafer after the half etching of the first dry etching process, FIG. 20C showing a second dry etching process of the silicon wafer, and FIG. 20D showing the wafer after removal of the $SiO_2$ film;

FIGS. 21A to 21D are further drawings used to describe the manufacture of the nozzle plate of the ink jet head shown in FIG. 15, FIG. 21A showing a second thermal oxidation process, FIG. 21B showing a third $SiO_2$ film patterning process, FIG. 21C showing a silicon wafer wet etching process, and FIG. 21D showing the wafer after removing the $SiO_2$ film;

FIG. 22 shows the final thermal oxidation film formation process in the manufacture of a nozzle plate for the ink jet head shown in FIG. 15;

DESCRIPTION OF THE PREFERRED EMBODIMENTS

Figure 1:
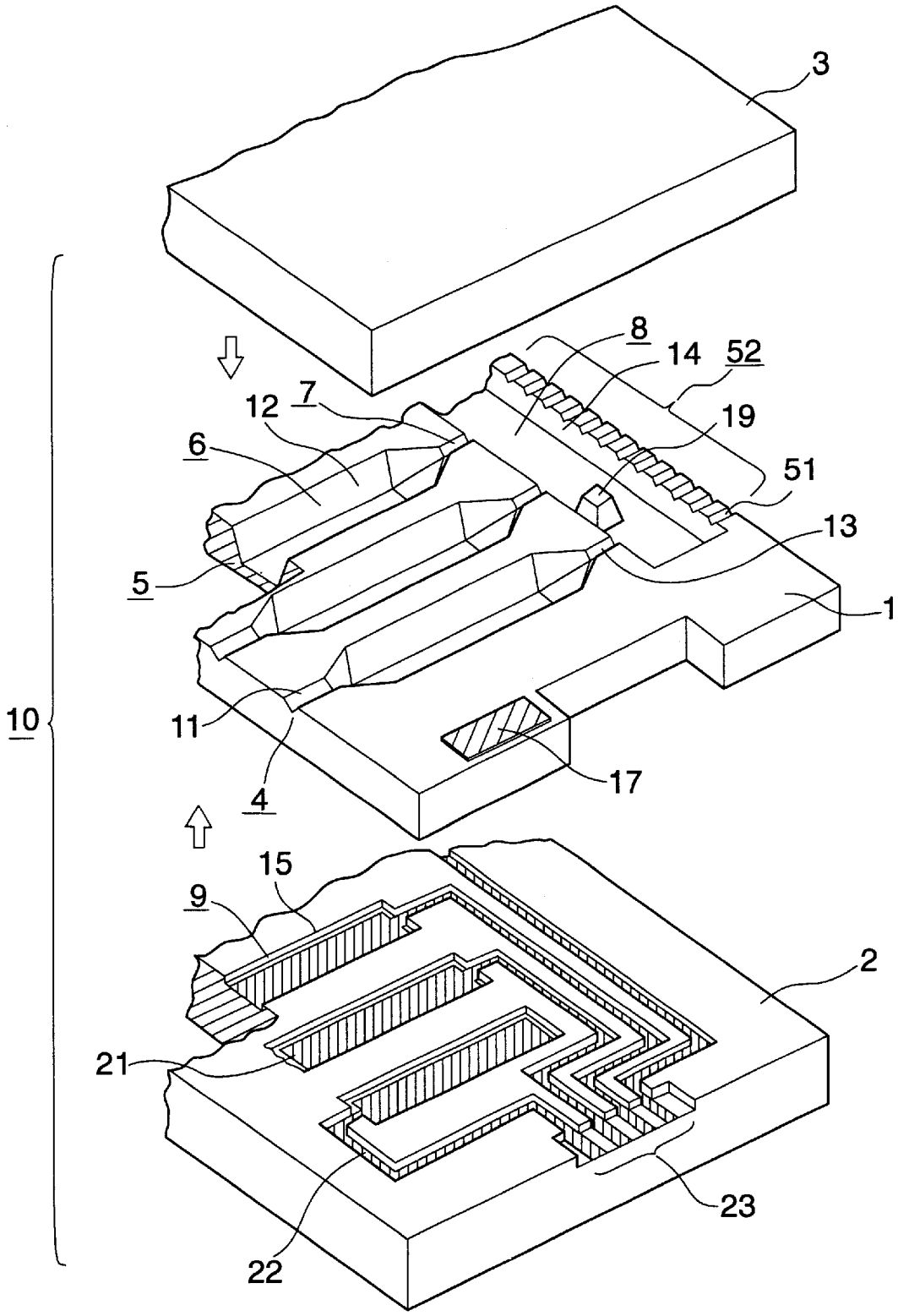
FIG. 1 is a partially exploded perspective view of an ink jet head according to the preferred embodiment of the present invention.

FIG. 1 is a partially exploded perspective view of an ink jet head according to the present invention. As shown therein, the ink jet head is an edge ejection type ink jet head whereby ink droplets are ejected from nozzles provided at the edge of the substrate. As will be appreciated by one of ordinary skill in are, the ink jet head may be implemented by a face ejection type ink jet head, whereby the ink is ejected from nozzles provided on the top surface of the substrate.

Referring specifically to FIG. 1, the ink jet head 10 in this embodiment is a laminated construction of three substrates 1, 2, 3 structured as described in detail below. The first and middle substrate 1 is arranged between substrates 2 and 3 and comprises a silicon wafer having plural parallel nozzle channels 11 formed on the surface of and at equal intervals from one edge of substrate 1 to form plural nozzles 4; corresponding recesses 12 in communication with a respective nozzle channel 11 and forming ejection chambers 6, which function as the pressure generating means and of which the bottom is diaphragm 5; orifice channels 13 functioning as the ink inlets and forming orifices 7 provided at the back of recesses 12; recess 14 forming common ink cavity 8, which is the ink supply member for supplying ink to each ejection chamber 6; and filter channels 51 forming filter 52 disposed at the back of recess 14.

Figure 3:
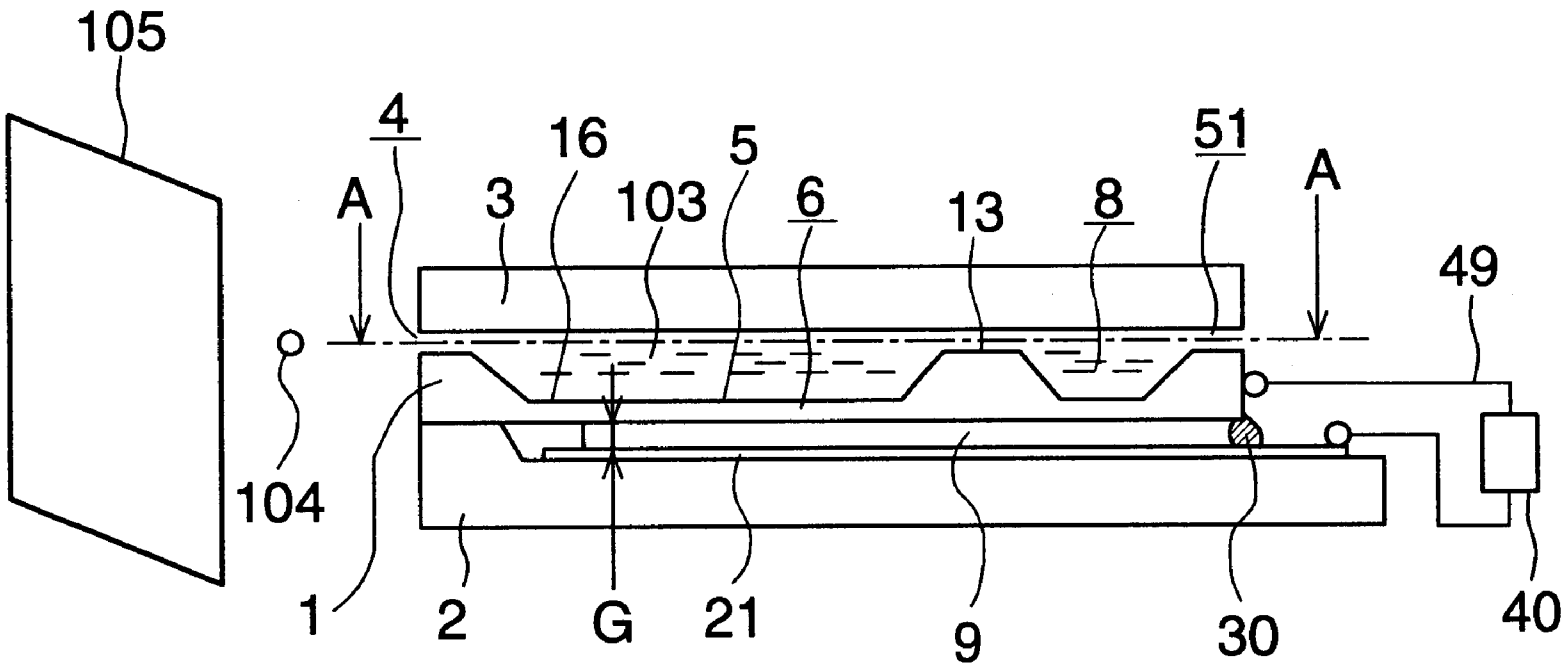
FIG. 3 is a side cross-sectional view of an ink jet head according to the preferred embodiment of the present invention.

Referring to FIGS. 1 and 3 in this embodiment, a gap holding means is formed by vibration chamber recesses 15 formed in second substrate 2 such that the gap between diaphragm 5 and the electrode disposed opposite thereto, i.e., length G (hereinafter the "gap length") of gap member 16, is the difference between the depth of recess 15 and the thickness of the electrode. It is to be noted that recesses may be alternatively formed in the bottom face of first substrate 1. In this embodiment, recess 15 is preferably etched to a depth of 0.3 $\mu$m. The pitch of nozzle channels 11 is preferably 0.509 mm, and the width is preferably 60 $\mu$m.

The relationship between the work functions of the semiconductor and metallic material used for the electrodes is an important factor affecting the formation of common electrode 17 to first substrate 1. In the present embodiment the common electrode is made from platinum over a titanium base, or gold over a chrome base, but the invention shall not be so limited and, as will be appreciated to one of ordinary skill in the art, other combinations may be used according to the characteristics of the semiconductor and electrode materials. For example, if substrate 1 is a p-type semiconductor, any materials whereby the work function of the common electrode material is greater may be used, and if substrate 1 is an n-type semiconductor, any materials whereby the work function of the common electrode material is less may be used.

Substrate 2 comprises borosilicate glass bonded to the bottom surface of first substrate 1. Vibration chambers 9 are formed in the top of second substrate 2, and recesses 15 comprising long, thin support member 30 are disposed in the middle of second substrate 2. Alternatively, support member 30 may not be provided if sufficient rigidity for ink ejecting is obtained by forming diaphragm 5 with sufficient thickness. It is preferable to provide support members 30 when the diaphragm is very thin. It is difficult to form diaphragms having about 5–10 $\mu$m thickness due to following reason. The diaphragm having 1–4 $\mu$m thickness can be obtained by forming an etch stop layer doped with high density boron and that a support member having a thickness greater than 10 $\mu$m can be obtained by keeping an etching time. So, it is difficult to obtain 5–10 $\mu$m thickness diaphragms precisely by applying conventional etching methods. The diaphragm produced by using an etch stop layer does not have sufficient rigidity for ink ejection. Therefore, the support member, that is shortened a span of a beam, is formed in the vibration chamber. On other hand, the diaphragm having above 10 $\mu$m thickness preferably does not require the support member.

In the preferred embodiment, a gap holding means is formed by vibration chamber recesses 15 formed in the top surface of second substrate 2 such that the gap between diaphragm 5 and the individual electrode disposed opposite thereto, i.e., length G (see FIG. 3; hereinafter the "gap length") of gap member 16, is the difference between the depth of recess 15 and the thickness of the electrode 21. It is to be noted that recesses 15 may be formed in the bottom of first substrate 1 as an alternative embodiment of the invention. In the present embodiment, recess 15 is etched to a depth of 0.3 $\mu$m. The pitch of nozzle channels 11 is 0.2 mm, and the width is 80 $\mu$m.

In the preferred embodiment, this bonding of second substrate 2 forms vibration chamber 9. Moreover, individual electrodes 21 are formed by sputtering gold on second substrate 2 at positions corresponding to diaphragm 5 to a 0.1 $\mu$m thickness in a pattern surrounding support members 30 and essentially matching the shape of diaphragms 5. Individual electrodes 21 comprise a lead member 22 and a terminal member 23. Terminal member 23 is provided for connecting to external driving circuits. It will be appreciated by those skilled in the art that while electrodes 21, 22 and 23 preferably consist of gold, other suitable materials, such as ITO or another conductive oxide film, may be substituted therefore.

The third and top substrate 3 comprises borosilicate glass and is bonded to the top surface of first substrate 1. Nozzles 4, ejection chamber 6, orifices 7, and ink cavity 8 are formed by this bonding of third substrate 3 to first substrate 1. Support member 19 providing reinforcement is also provided in ink cavity 8 to prevent collapsing recess 14 when first substrate 1 and third substrate 3 are bonded together.

First substrate 1 and second substrate 2 are anodically bonded at 300~500° C. by applying a 500~1000-V charge. First substrate 1 and third substrate 3 are then bonded under the same conditions to assemble the ink jet head, as shown in FIG. 3. After anodic bonding, gap length G formed between diaphragms 5 and individual electrodes 21 on second substrate 2 is defined as the difference between the depth of recess 15 and the thickness of individual electrodes 21, and is 0.2 $\mu$m in this embodiment. A silicon oxide film is then formed preferably by thermal oxidation on the surface of diaphragm 5 in substrate 1. This process forms an insulation layer preventing short-circuit breakdown if electrode 21 contacts diaphragm 5. Field strength will be low if the thermal oxidation insulation film is too thick, and dielectric breakdown as a result of repeated field stress is facilitated if the film is too thin. This thermal oxidation film is therefore preferably 0.13 $\mu$m thick in this embodiment.

Figure 2:
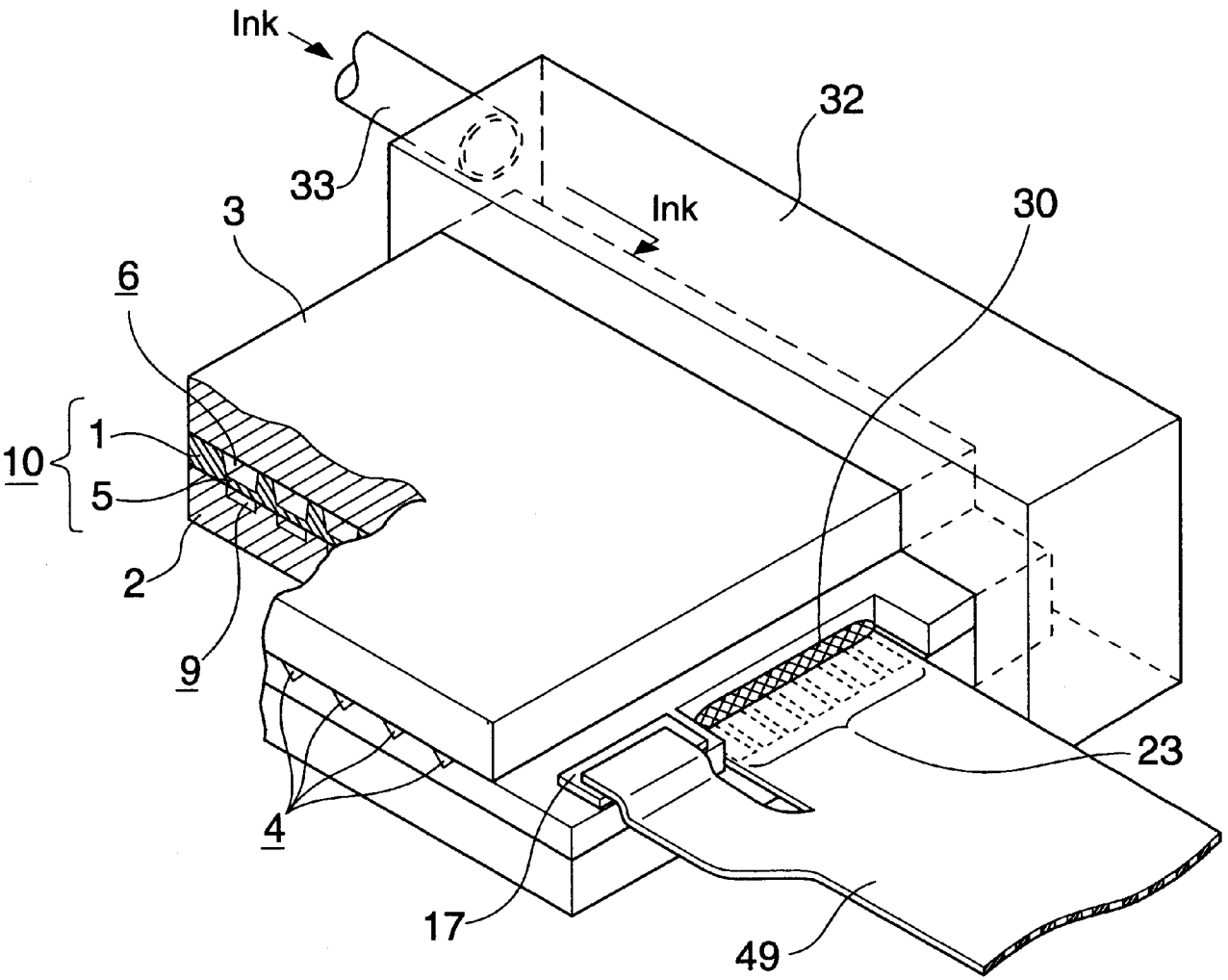
FIG. 2 is a perspective view of an ink jet head according to the preferred embodiment of the present invention.

Referring to FIGS. 2 and 3, after thus assembling the ink jet head, drive circuit 40 is connected by connecting flexible printed circuit (FPC) 49 between common electrode 17 and terminal members 23 of individual electrodes 21, thus forming an ink jet printer. Ink 103 is supplied from the ink tank (not shown in the figures) through filter 51 into first substrate 1 to fill common ink cavity 8 and ejection chambers 6. Upon application of a driving signal by drive circuit 40 to an individual electrode 21, the ink in ejection chamber 6 becomes ink drop 104 ejected from nozzles 4 and printed to recording paper 105 when ink jet head 10 is driven.

Figure 4:
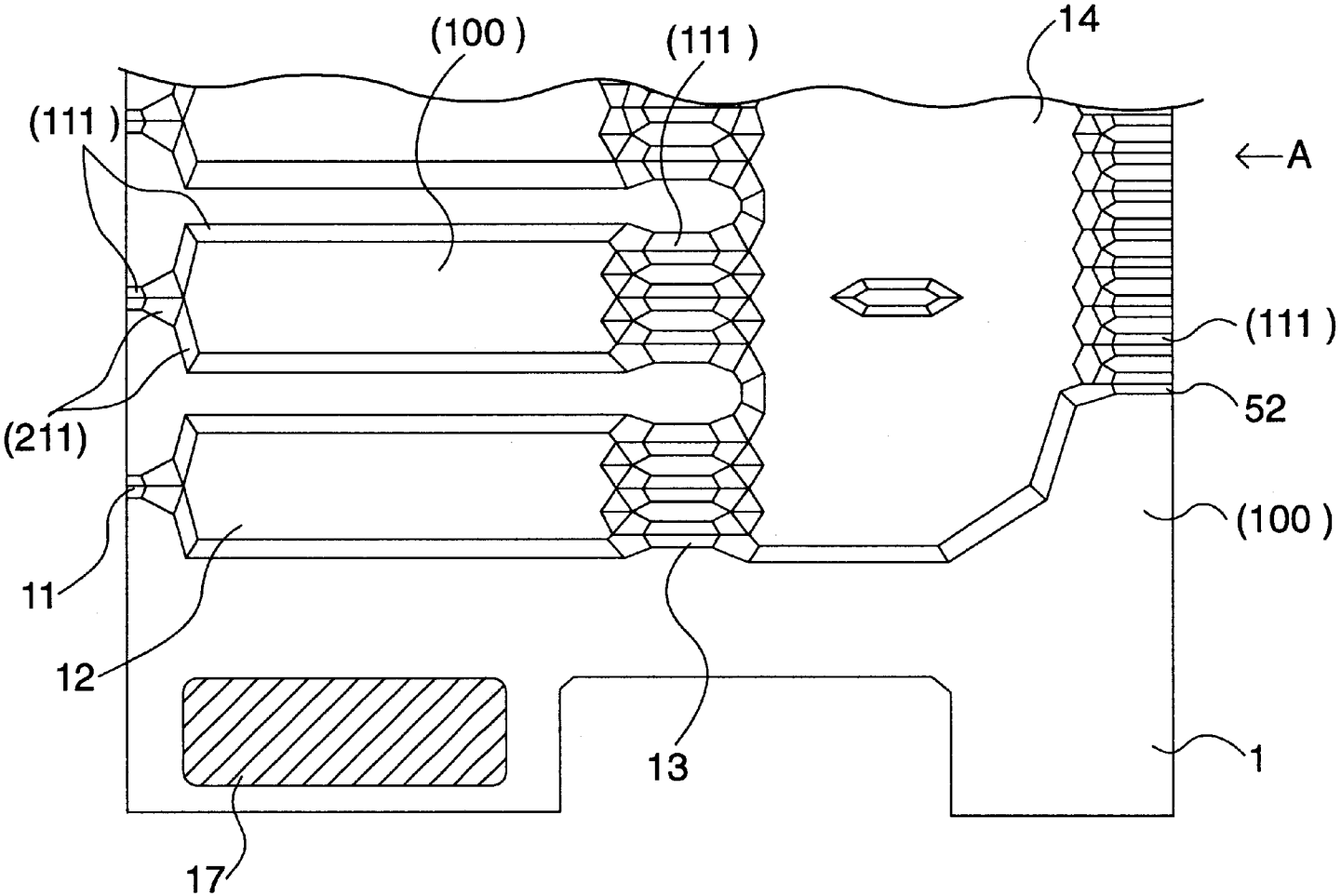
FIG. 4 is an enlarged plan view of a substrate of the ink jet head according to the preferred embodiment of the present invention.

FIG. 4 is an enlarged partial cross-sectional view of substrate 1. Substrate 1 of an ink jet head according to the present embodiment is manufactured by anisotropic etching of a single crystal silicon substrate. Anisotropic etching is an etching processing in which the etching speed varies according to the etching direction. The etching speed of face (100)

in single crystal silicon is approximately forty times that of face (111), and this is used to form nozzle channels 11, recesses 12, orifice channels 13, recess 14, and filter channels 52 in the present embodiment.

Nozzle channels 11, orifice channels 13, and filter channels 52 are formed as V-shaped grooves from faces (111) where the etching speed is slower, resulting in the nozzle channels 11, orifice channels 13, and filter channels 52 having a triangular cross section. Nozzle channels 11 are 60 μm wide at the base of the triangle. Orifice channels 13 form three parallel flow channels, each width of which is 55 μm. Filter channels 52 are 50 μm wide, and 54 parallel filter channels 52 are formed in communication with recess 14.

Recesses 12 and 14 are trapezoidal channels of which the bottom is face (100) and the sides are face (111). The depth of recesses 12 and 14 is controlled by adjusting the etching time. The V-shaped nozzle channels 11, orifice channels 13, and filter channels 52 are shaped only by face (111), which has the slower etching speed, and the depth is therefore controlled by the channel width independent of the etching time.

These nozzle channels 11, orifice channels 13, and filter channels 52 are extremely sensitive contributors to the ink eject volume and speed characteristics of the ink jet head, and require the highest processing precision. In the present embodiment, those parts requiring the highest processing precision are made using the faces with the slowest etching speed by means of anisotropic etching, making it possible to obtain channels of different dimensions with high precision.

As described above, the width of the filter channels 52 is made narrower than the width of the nozzle channels 11 and orifice channels 13, thereby assuring that the cross-sectional area of the openings for the filter 51 formed inside the ink passage by bonding the third substrate to the first substrate will have the smallest cross-sectional area of any part of the ink passage. As a result, foreign particulate that could clog the nozzles 4 or orifices 7 is reliably blocked by the filter 51 from entering the ink passage. A major factor in dropped pixels and other printing defects is thus eliminated, and the reliability of the ink jet head can be assured. Production yield is also improved, and an ink jet head that can be easily mass produced can be obtained, because blockage of the nozzle holes and orifices during ink jet head production can be prevented.

Figure 5A:
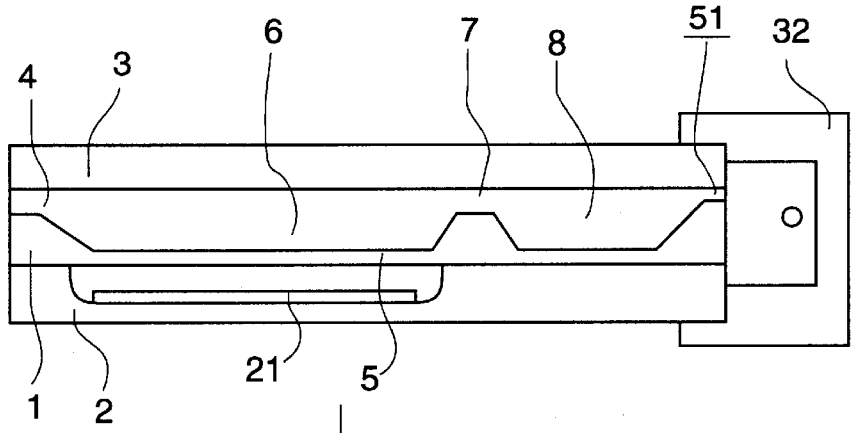
FIGS. 5A–5C are side cross-sectional views showing the ink eject operation of an ink jet head according to the preferred embodiment of the present invention.
Figure 5B:
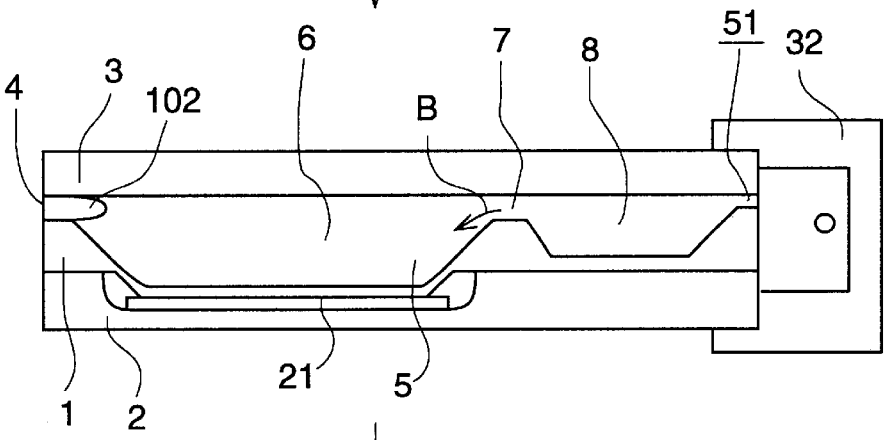
Figure 5C:
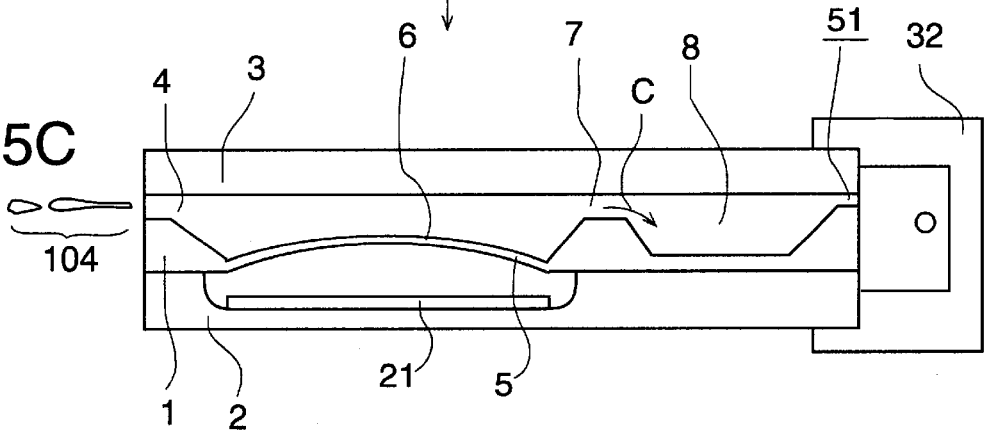
Figure 6A:
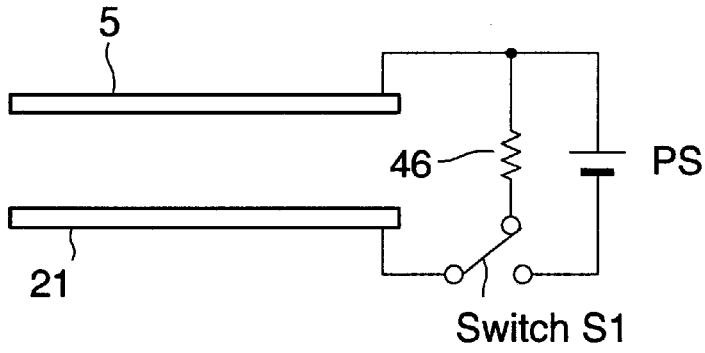
FIGS. 6A–6C are simplified illustrations of the effects when voltage is applied between the diaphragm and electrode of the ink jet head shown in FIGS. 5A–5C.
Figure 6B:
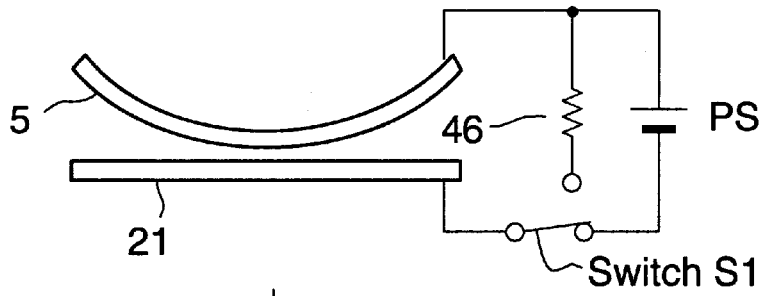
Figure 6C:
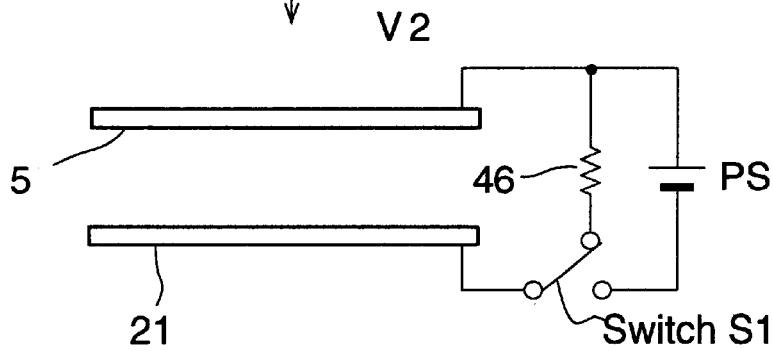

FIGS. 5A–5C are side cross-sectional views of an ink jet head according to the preferred embodiment of the invention, and are used below to describe the process whereby the diaphragm is deformed from the standby position to cause ink to be ejected from the nozzle. FIGS. 6A–6C are simplified illustrations depicting the effects of a voltage being applied between the diaphragm and electrode in the corresponding states shown in FIGS. 5A–5C. An example of ink jet head operation according to the present invention is described below with reference to FIGS. 5A–5C and 6A–6C.

FIG. 5A is a side cross-sectional view of the ink jet head in the standby state, and FIG. 6A illustrates the potential between diaphragm 5 and individual electrode 21 at that time. As can be seen therein, switch S1 is set such that diaphragm 5 is electrically connected to individual electrode 21 resistor 46. In this arrangement a potential that has previously formed is effectively discharged. The ink jet head is in the standby state at this time, i.e., the ink passage is filled with ink and the ink jet head is ready to eject ink. When switch S1 is moved to its second position, electrodes 5 and 21 are connected to power supply PS and thus a voltage is applied between diaphragm 5 and individual electrode 21 in the standby state to create a potential difference as shown in FIG. 6B. The force of electrostatic attraction acts on diaphragm 5 and individual electrode 21 results from this potential difference, causing diaphragm 5 to be pulled toward individual electrode 21. The attraction of diaphragm 5 to individual electrode 21 at this time causes the pressure inside ejection chamber 6 to drop as shown in FIG. 5B, and ink is supplied in the direction of arrow B from common ink cavity 8 to ejection chamber 6. The meniscus 102 formed by nozzle 4 at this time is also pulled toward ejection chamber 6. Next, as shown in FIG. 6C, switch Si is placed in its initial position at the timing whereby sufficient ink is supplied to ejection chamber 6, and the charge stored to diaphragm 5 and individual electrode 21 is discharged through resistor 46, diaphragm 5 is released by the field strength and returned into ejection chamber 6 by its inherent restoring force. The return of diaphragm 5 increases the pressure in ejection chamber 6, thus causing ink dot 104 to be ejected from nozzle 4, and the remaining ink in the ejection chamber 6 to be returned in the direction of arrow C through orifice 7 to common ink cavity 8, as shown in FIG. 5C. The oscillation of ink in the ink passage is buffered and converged by the flow resistance, and diaphragm 5 returns to the standby position shown in FIG. 5A and is ready for the next ejection operation.

In the above drive method, the diaphragm is not deformed in the standby state and is only deformed when driven, thus releasing the force applied to the diaphragm immediately after the pressure inside the ejection chamber is reduced, thus causing the pressure inside the ejection chamber to rise and ejecting an ink drop from the nozzle (a so-called "pull-push-ejection" method). It is to be noted that a so-called "push-ejection" method whereby the diaphragm is constantly deformed in the standby state and released only during ink jet head drive to eject ink may be alternatively used. The "pull-push-ejection" method described in the present embodiment provides a greater ink eject volume and improved frequency characteristics. It is to be further noted that the action and effect of the present invention are the same even if the drive force and drive method differ.

The channel constants of the ink jet head according to the present embodiment are described next.

Various properties of the ink passage of an ink jet head are determined by the viscosity and density of the ink combined with the cross-sectional area perpendicular to the ink flow line, the circumference of the flow line, and the length of the ink passage.

Inertance M is defined as:

$$M = \frac{\rho L}{S} \quad [1]$$

where ρ is the ink density, L is the length of the channel, and S is the cross-sectional area perpendicular to the flow line of the channel.

Inertance M is the resistance to the volume acceleration of ink; the greater the inertance M, the greater the resistance to acceleration and such forces as the generated pressure.

The flow resistance R is defined as:

$$R = \frac{2\eta T^2 L}{S^3} \quad [2]$$

where η is the ink viscosity, and T is the cross-sectional circumference of the channel. This value indicates the resistance to the volume velocity of the ink; the greater the flow resistance R, the greater the resistance to ink flow.

The ink compliance C is defined as:

$$C = \frac{W}{c^2\rho} \quad [3]$$

where c is the speed of sound through the ink, and W is the volume of the ink passage. The ink compliance C indicates the deformation resistance of the ink; the greater the ink compliance C, the easier the ink deforms, i.e., the greater the ability of the ink to buffer pressure changes.

These various ink channel constants are adjusted to control the balance between the constants and assure consistent ink ejecting.

Common ink cavity 8 and filter 51 also have a. specific inertance, flow resistance, and ink compliance. Using the drive method of the present embodiment described with reference to FIGS. 5A–5C and 6A–6C above, the inertance, flow resistance, ink compliance, and other channel constants of common ink cavity 8 and filter 51 are determined relative to the channel constants of the ink passage to prevent ink supply deficiencies and cross talk (pressure interference between ink passages) causing ink to be ejected from non-driven nozzles.

An example of the channel constants set for common ink cavity 8 and filter 51 is described in detail below.

Figure 7:
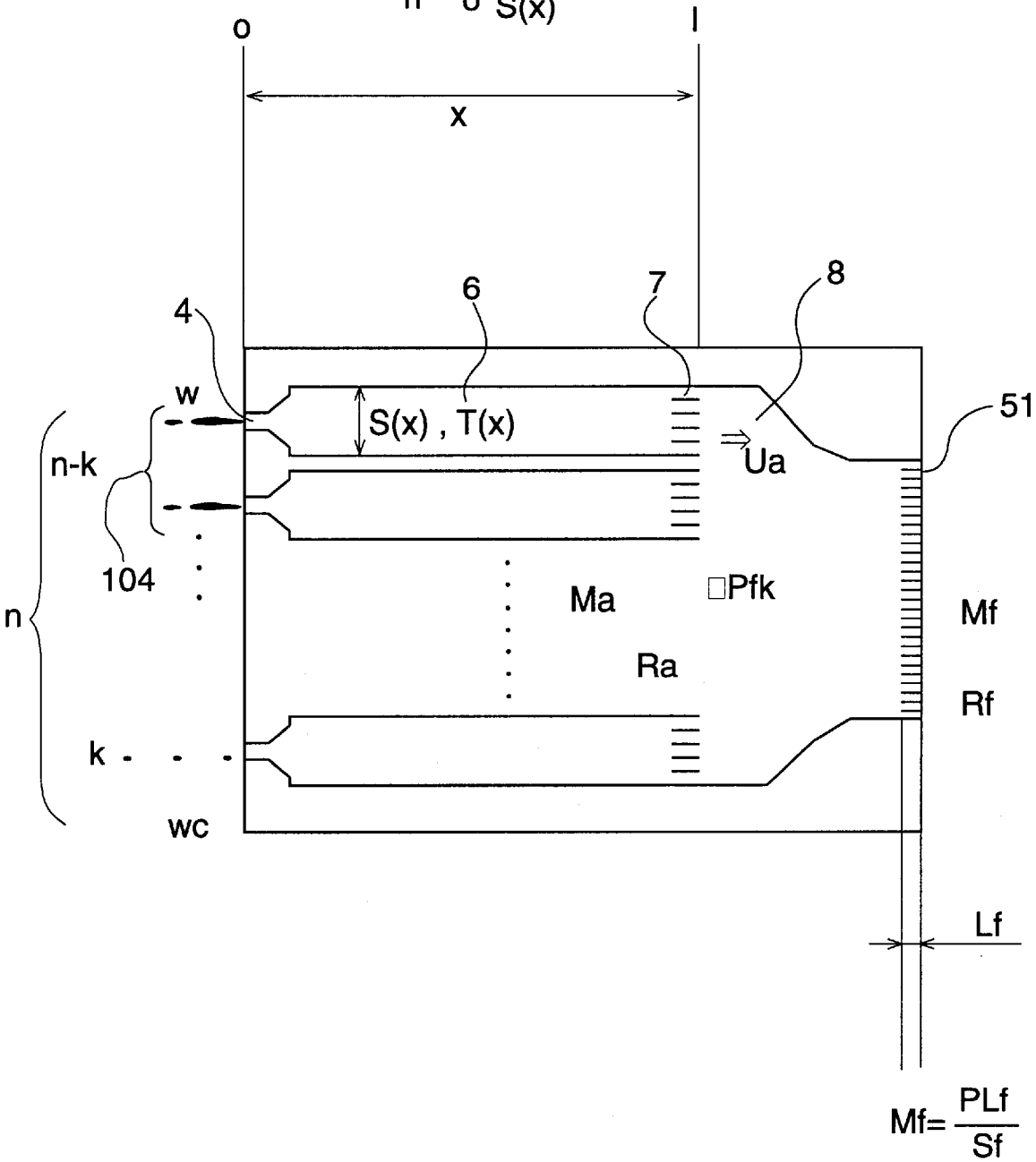
FIG. 7 depicts the various channel constants of the ink passage in an ink jet head according to the preferred embodiment of the present invention.

FIG. 7 is a plan view of the preferred embodiment of the invention, and is used below to describe the channel constants of common ink cavity 8 and filter 51.

The following description is premised upon ejecting ink drops 104 from (n–k) nozzles of an ink jet head comprising n nozzles by driving the actuators disposed in the ejection chambers 6 as described above; k is the number of non-driven nozzles. As described above, the channel constants of common ink cavity 8 and filter 51 are set to prevent ink ejecting from non-driven nozzles due to cross talk.

Simultaneously to the ejecting of ink drop 104 from nozzle 4, some of the ink is returned through orifice 7 to common ink cavity 8.

It is assumed below that: w is the ink volume per eject from one driven nozzle; Ua is the volume velocity of the ink back flowing from orifice 7 of one driven nozzle to common ink cavity 8; n is the number of parallel nozzles 4; Ma is the total inertance of all ink passages in the eject unit from nozzle 4 to orifice 7; Ra is the total flow resistance of the ink passage; Mf and Rf are the inertance and flow resistance, respectively, of the filter 51, these inertance or resistance can be written by;

$$Mf = \frac{\rho Lf}{Sf} \quad [4]$$

$$Rf = \frac{2\eta Tf^2 Lf}{Sf^3} \quad [5]$$

where Lf is the length of the filter channels 52, Sf is the total cross sectional area of all filter channels 52, and Tf is sum of the cross-sectional circumferences of the filter channels 52.

$$Ma = \frac{\rho}{n}\int_0^l \frac{1}{S(x)}\,dx \quad [6]$$

-continued $$Ra = \frac{2\eta}{n}\int_0^l \frac{T(x)^2}{S(x)^3}\,dx \quad [7]$$

where l is the total length of an ink passage plus associated nozzle, S(x) is the cross sectional area of the ink passage at coordinate x, and T(x) is the cross-sectional circumferences of the ink passage at coordinate x as defined in FIG. 7.

Figure 8:
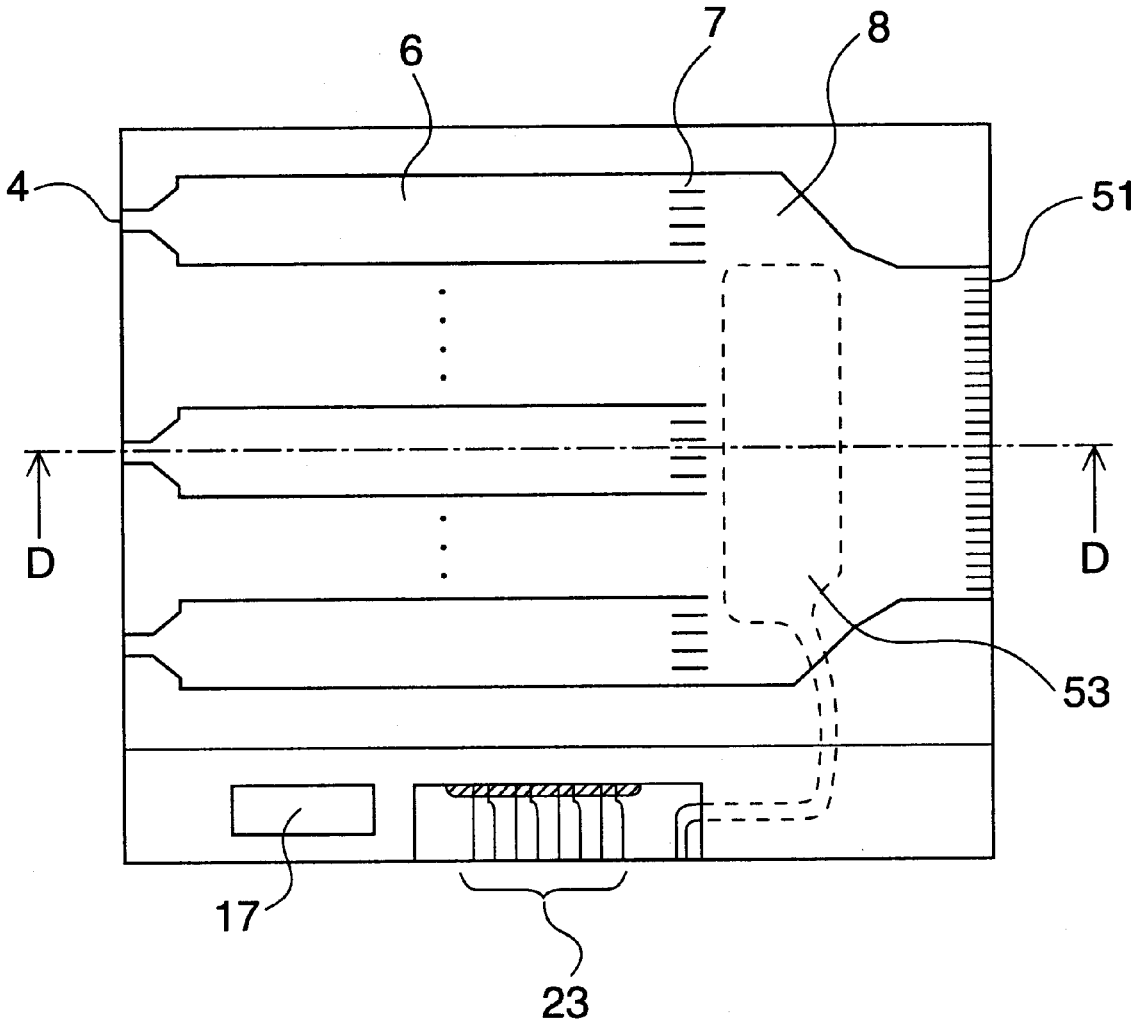
FIG. 8 is a cross-sectional view of an ink jet head according to an alternative embodiment of the invention.

The pressure increase $\delta P_{fk}$ in common ink cavity 8 when ink drop 104 is ejected in the state shown in FIG. 8 is thus:

$$\delta P_{fk} = \frac{n\alpha(n-k)}{n+\alpha k}\, Ma\, \frac{dUa}{dt}. \quad [8]$$

where α is the ratio between the inertance Ma of the complete eject unit and the inertance Mf of the filter, and is α=Mf/Ma; and t is time.

The ink ejection volume from one non-driven nozzle at this time, i.e., the cross talk capacity $w_c$ resulting from the mutual interference between ink passages, is the second integral of the pressure increase $\delta P_{fk}$ in common ink cavity 8 divided by nMa, and is therefore:

$$w_c = \frac{\alpha(n-k)}{n+\alpha k}\,\beta w \quad [9]$$

where β is a constant determined by the balance between inertance and flow resistance on the nozzle-side of the ink passage, and the inertance and flow resistance on the orifice-side of the ink passage, and is a ratio between the ink volume w per eject from the nozzle and the ink volume back-flowing from the orifice to the common ink cavity. The ratio β is defined as:

$$\beta = \frac{1}{w}\int u_a\,dt. \quad [10]$$

In an ink jet head with twelve nozzles, n>k and α<1 when there is one non-driven nozzle, and cross talk $w_c$ is:

$$w_c \approx \alpha\beta w. \quad [11]$$

To prevent cross talk from occurring in the present embodiment, the relationship between α, i.e., Mf/Ma, and cross talk was experimentally determined (the results are shown in Table 1). Based on these results, the ratio Mf/Ma is set to 0.2 or less, and in sample 4 was 0.121.

When all n nozzles are driven at the highest frequency fd, the channel constants of common ink cavity 8 and filter 51 were determined to prevent any ink supply deficiency.

More specifically, to prevent an ink supply deficiency and the intake of air from the nozzle 4, and assure stable drive, the relationship between α and cross talk must satisfy the equation:

$$nwfd(R_f + R_a) < \frac{\gamma Ta\cos\theta}{Sa}\cdot Ph \quad [12]$$

where: γ is the surface tension of the ink; Ta is the circumference of nozzle 4; Sa is the surface area of nozzle 4; θ (θ≈0) is the contact angle between the ink and head material (e.g., single crystal silicon); and Ph is the pressure added to the ink supply system supplying ink from an external supply to the ink jet head. For example, if the ink tank storing the ink to be supplied to the head is made of a flexible material, deformation of the ink tank applies negative pressure from an external source to the ink jet head; depending on the height relationship (level difference) between the ink jet head and ink tank, a specific positive pressure is also applied externally to the ink jet head. If the flow resistance Rf of common ink cavity 8 and filter 51 is low enough relative to the flow resistance Ra of the complete ink passage to be ignored, an ink supply deficiency resulting from the provision of filter 51 will not occur. Based on the experimental results shown in Table 1, the Rf/Ra ratio is set to a maximum 0.25, and in sample 4 was 0.173.

The results of tests relating to cross talk and ink supply deficiencies using ink jet heads constructed according to the present invention are shown in Table 1. The ink jet head used in these tests had twelve nozzles.

TABLE 1

| | | Sample | | | |
|---|---|---|---|---|---|
| | | 1 | 2 | 3 | 4 |
| Inertance of filter 51 (Mf) | $\times 10^8$ kg/m$^4$ | 0.105 | 0.608 | 0.078 | 0.039 |
| Flow resistance of filter 51 (Rf) | $\times 10^{12}$ Nsec/m$^5$ | 0.318 | 0.383 | 0.021 | 0.100 |
| Ink capacity of common ink cavity 8 (Cr) | $\times 10^{-19}$ m$^5$/N | 7.117 | 2.312 | 8.374 | 2.444 |
| Inertance ratio (Mf/Ma) | % | 17.7 | 18.1 | 34.3 | 12.1 |
| Flow resistance ratio (Rf/Ra) | % | 24.1 | 38.5 | 3.8 | 17.3 |
| Ink capacity ratio (Cr/Ca) | % | 45.7 | 19.8 | 35.2 | 10.4 |
| Results | | | | | |
| Cross talk (pressure interference between ink passages) | | o | o | x | o |
| Supply deficiency (poor response, inconsistent ejecting) | | o | x | o | o |
| Ink ejection volume w | $\mu$g/dot | 0.093 | 0.128 | 0.153 | 0.165 |

o: good
x: unacceptable (problems detected)

Inconsistent ink ejection caused by supply deficiencies during high frequency drive were observed with sample 2 in Table 1. When eleven nozzles were driven and one was non-driven as in sample 3, ink eject from the non-driven nozzle was also observed. No cross talk or supply deficiencies were observed with samples 1 and 4. The greatest per-eject ink volume w was observed with sample 4, which yielded the best ink eject characteristics. Sample 4 had 58 filter holes, each 45 $\mu$m wide and 50 $\mu$m long.

Figure 9:
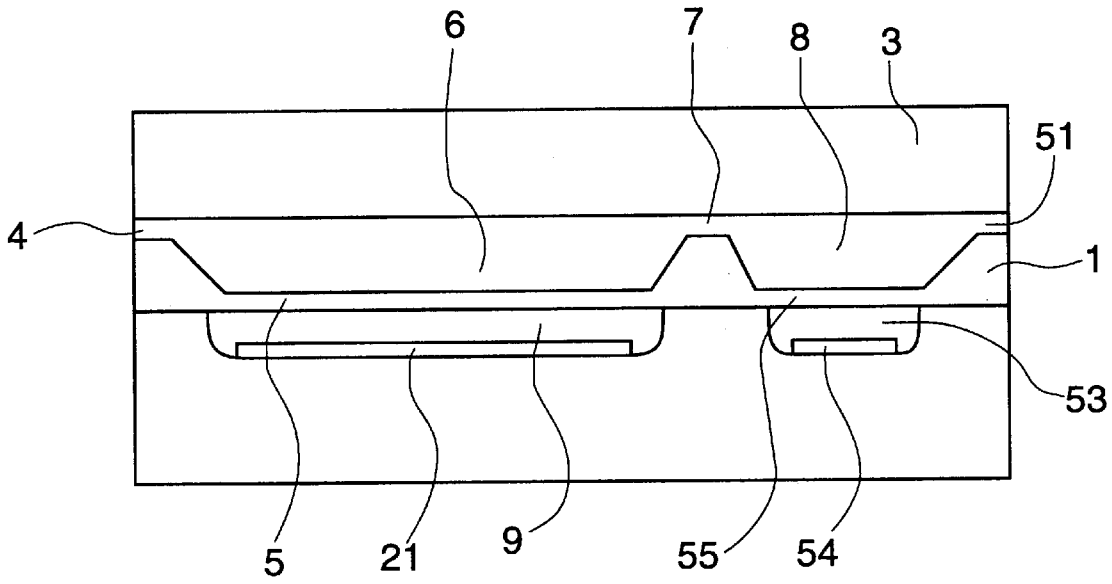
FIG. 9 is a cross-sectional view taken along line D—D in FIG. 8.

FIG. 8 is a plan view of an alternative embodiment of the invention. FIG. 9 is a cross-sectional view taken along line D—D of FIG. 8. The embodiment shown in FIG. 8 comprises plural parallel ink passages, only part of which is shown.

As shown in FIGS. 8 and 9, this embodiment comprises a pressure buffer chamber 53, which is a space formed below the ink supply unit; a transparent oxide conductive film 54 formed inside pressure buffer chamber 53 from the same ITO material as individual electrodes 21; and buffer wall 55 corresponding to the bottom wall of the ink supply unit and having the same thickness as diaphragm 5. The pressure increase in common ink cavity 8 created when ejection chamber 6 in the ink passage is driven is absorbed, buffered, and effectively cancelled by buffer wall 55. This construction prevents pressure interference between ink passages and ink supply deficiencies caused by providing filter 51.

The primary reason for providing transparent oxide conductive film 54 is to prevent buffer wall 55 from adhering to second substrate 2 and becoming nonfunctional when substrate 1 and second substrate 2 are anodically bonded.

When the ink capacity (compliance) of common ink cavity 8 is sufficiently great, the pressure created by the driven nozzles and transferred to common ink cavity 8 can be buffered by the ink compliance alone. By actively disposing buffer wall 55 as in this embodiment, sufficient compliance can be obtained even with a small capacity common ink cavity 8, and the pressure generated in common ink cavity 8 during ink jet head drive can be sufficiently buffered. Providing buffer wall 55 also increases the range of channel constants available to filter 51, i.e., by providing buffer wall 55, pressure can still be buffered and cross talk therefore does not occur even if the inertance of filter 51 is high relative to the total inertance of the ink passage.

It is to be noted that the force of electrostatic attraction is used as the pressure generating means in the above embodiments, but, as will be appreciated by one skilled in the art, it is also possible to provide a piezoelectric element as the pressure generating means on the side of diaphragm 5 opposite ejection chamber 6. In this case an appropriate voltage is applied to the piezoelectric device to deform the diaphragm. The pressure generating means may alternatively comprise a resistance heating element disposed in ejection chamber 6 such that the pressure ejecting the ink is created by the thermal expansion of the ink induced by the resistance heating element. It is to be further noted that the action and effect of the present invention are the same irrespective of the type of pressure generating means used.

While the pressure generating means of the invention shall not be limited to a means using the force of electrostatic attraction, high ink pressure can be obtained, depending on the gap, by using electrostatic attraction as the pressure generating means, and the head construction can be simplified. In addition, the greatest benefit can be obtained from the present invention when electrostatic attraction is used for the pressure generating means.

Figure 10:
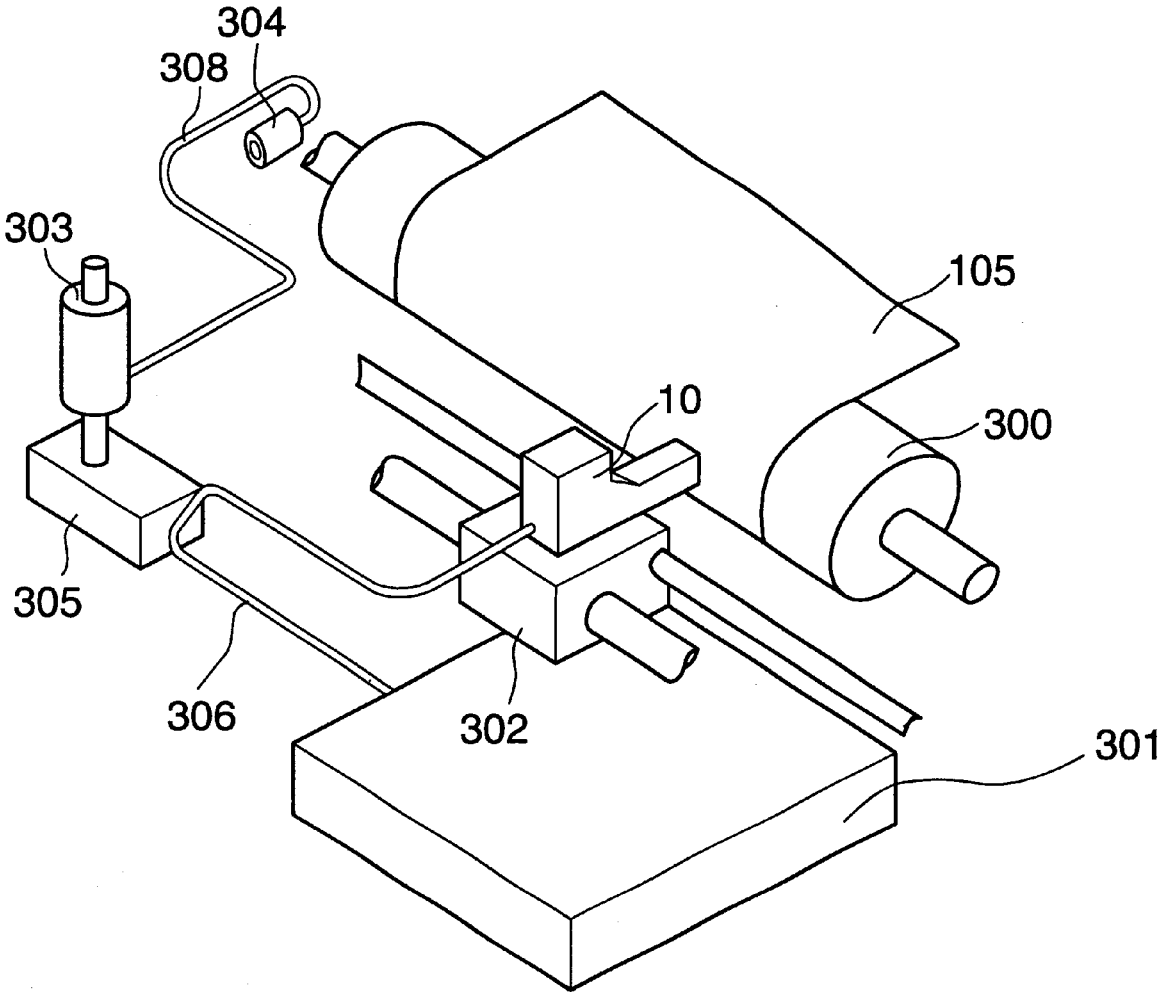
FIG. 10 is a schematic diagram of an ink jet recording apparatus according to the present invention.

FIG. 10 is a schematic view of an ink jet recording apparatus according to the present invention comprising the above ink jet head 10. Platen 300 transports recording paper 105, and ink tank 301 stores the ink internally for supplying ink to ink jet head 10 through ink supply tube 306. Carriage 302 reciprocally moves ink jet head 10 in the direction perpendicular to the transport direction of recording paper 105. The desired text and graphics can be printed to paper 105 by the drive circuit 40 ejecting ink drops 104 from ink jet head 10 at the appropriate timing while driving the carriage 302. Pump 303 functions to suction ink through cap 304 and waste ink recovery tube 308 for recovery to waste ink reservoir 305 when there is an ink eject defect or other problem in ink jet head 10, and when the ink is replaced.

Inclusion of filter in ink jet head 10 in the ink jet recording apparatus according to the present invention prevents the penetration of foreign particulate to ink jet head 10, thereby eliminating the need to provide a filter inside ink tank 301 and ink supply tube 306, and simplifying the ink supply system. In addition, only ink jet head 10 is disposed on carriage 302 in the present embodiment, but the invention shall not be so limited and the same desirable effects can be obtained whether the ink tank is disposed on the carriage, or whether a disposable ink jet head integrating the ink tank with the printer head is used (in which case the complete ink jet head is thrown away when the ink tank is emptied of ink).

The manufacturing method of an ink jet head according to the present invention is described below with reference to FIGS. 11A–11D, 12, 13 and 14.

FIGS. 11A–11D describe the process of this manufacturing method for forming the channels in substrate 1. FIGS.

Figure 11A:
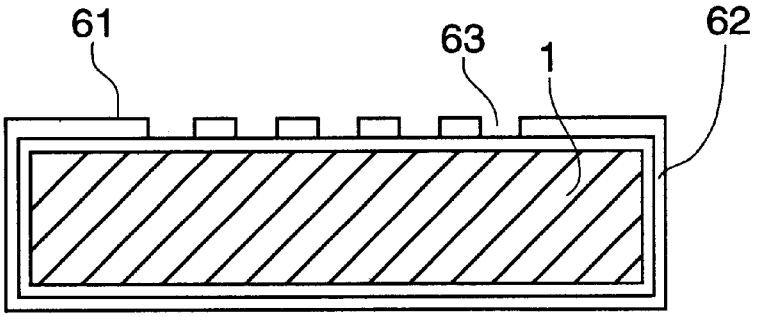
Figure 11A:
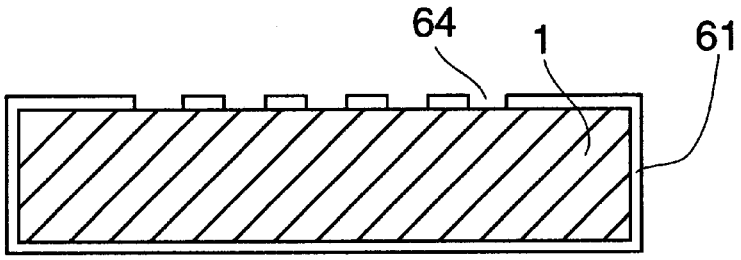

11A–11D each show cross-sectional views of the part of the ink jet head to which the filter channels 52 are formed in substrate 1. As shown in FIG. 11A, a $SiO_2$ thermal oxidation film 61 is formed to a thickness of 6000 Å by thermal oxidation at 1100° C to the surface of substrate 1, which is single crystal Si. A resist film 62 is then formed by coating the surface of substrate 1 with a photosensitive resin.

Referring again to FIG. 11A, after resist film 62 is coated to and dried on the surface of substrate 1 coated with the $SiO_2$ thermal oxidation film, a positive mask describing the pattern of filter channels 52 is used to expose the resist film 62 with ultraviolet light. The resist film 62 is then developed, rinsed, and dried to form the filter channel 52 pattern. The line width of the filter channel 52 pattern is made narrower than the line width of the pattern for forming nozzle channels 11 and orifice channels 13.

The oxide film is then etched using a BHF etching solution of 1:6 (volume ratio) hydrofluoric acid and ammonium fluoride. This etching process removes the oxide film in the pattern forming filter channels 52. Resist film 62 is then peeled away, resulting in the state shown in FIG. 11B. The oxide film used for the pattern of the channels forming the ink passages and ink supply unit is also removed at this time.

Figure 11C:
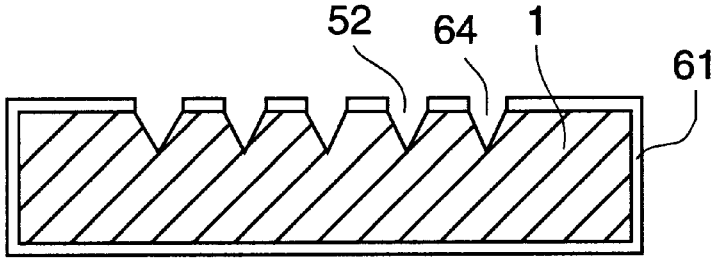

The single crystal Si of substrate 1 is then etched using an aqueous solution of potassium hydroxide (KOH) and ethanol. As described above, the etching speed of face (100) of single crystal silicon is 40 times faster than that of face (111), and face (111) is therefore exposed by this etching process. FIG. 11C shows the substrate after single crystal silicon etching. At this time, filter channels 52 are formed by only faces (111) of the single crystal Si.

Because filter channels 52 are formed by the relatively slow etching speed faces (111), there is virtually no etching of these faces (111), and the filter channels 52 can be formed with a consistent width and depth controlled by the line width of the mask pattern. The other ink passage and ink supply unit channels can be similarly formed with high precision.

Figure 11D:
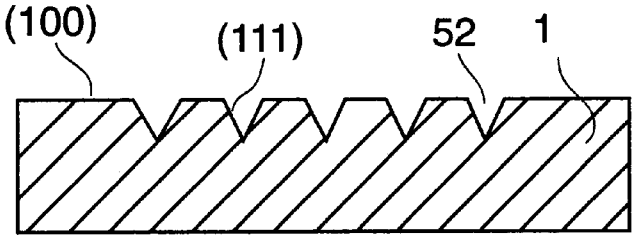

After forming the channels, the substrate is washed with hot sulfuric acid, then vapor washed with isopropyl alcohol, and the thermal oxidation film on the surface is removed with BHF. FIG. 11D shows the completed channels after removing the thermal oxidation film. A protective thermal oxidation film is then formed again on substrate 1 to complete substrate 1.

Figure 12:
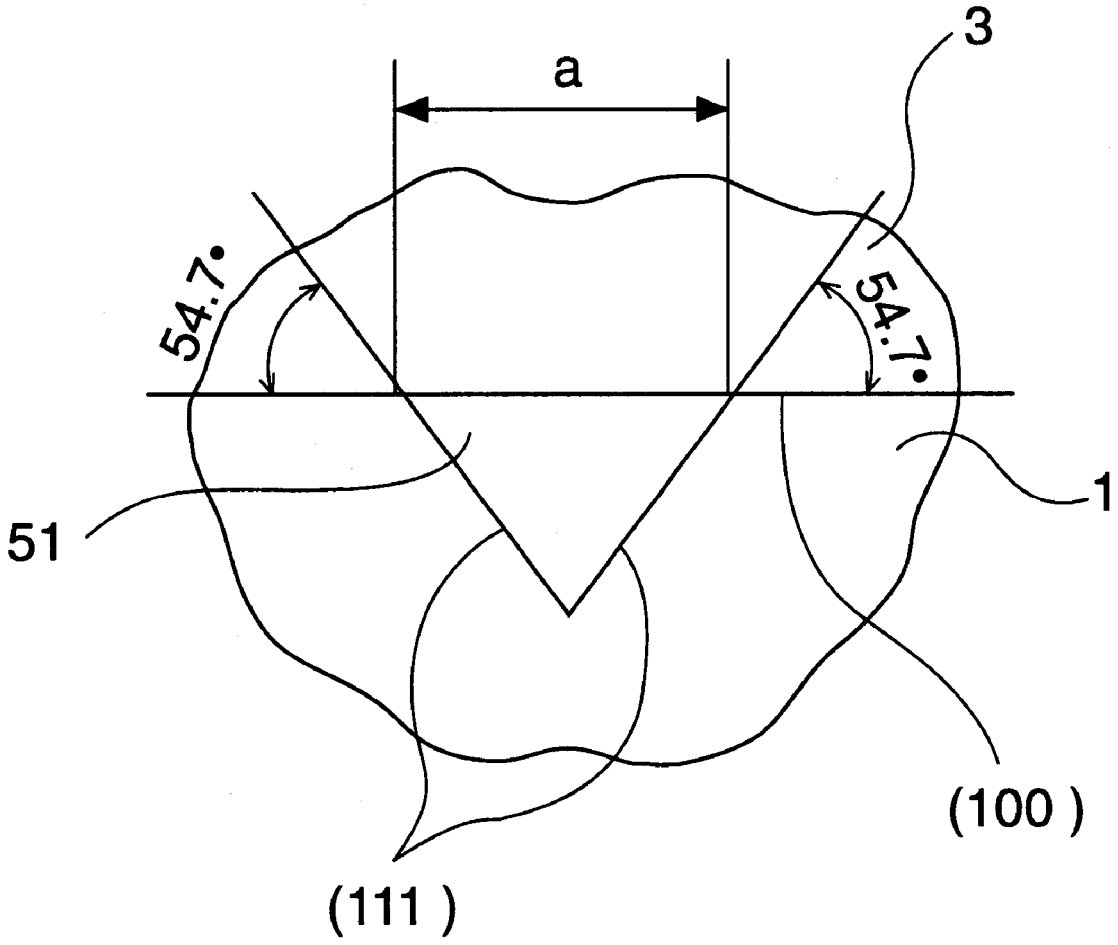
FIG. 12 is an enlarged view of an exemplary filter of the ink jet head according to the preferred embodiment of the present invention.
Figure 13:
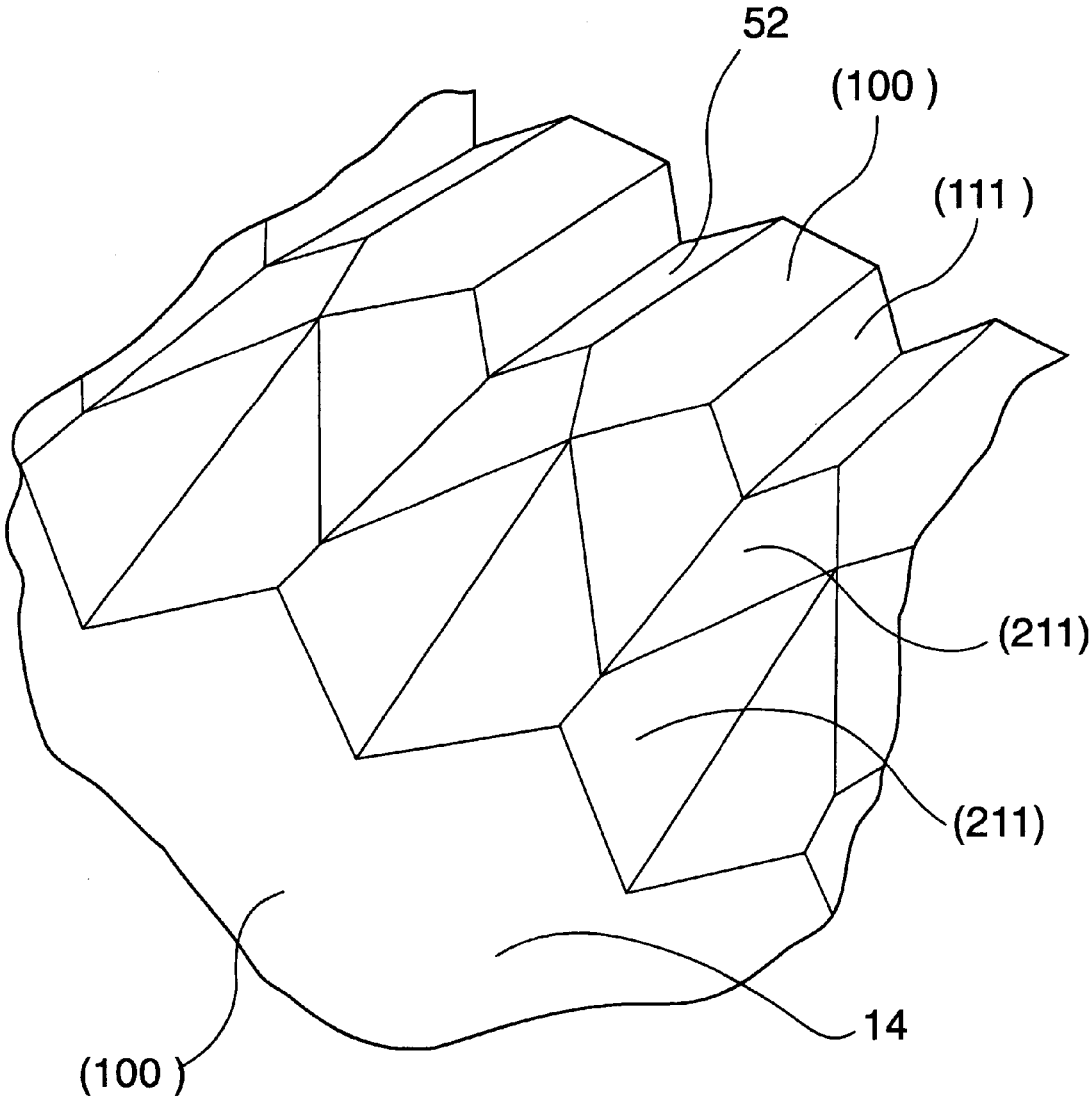
FIG. 13 is an enlarged perspective view of the filter channels in an ink jet head according to the present invention.

FIG. 12 is an enlarged view of an exemplary filter 51 in the direction of arrow A in FIG. 4. FIG. 13 is an enlarged perspective view of filter channels 52 after etching as seen from the recess 14. Filter 51 are formed by etching filter channels 52, bonding the first, second, and third substrates 1, 2, and 3 together, and then slicing the substrates to expose the filter. As a result, the filter has a triangular cross section comprising two single crystal Si (111) faces and one (100) face, which is the face used to bond the substrates together. By thus comprising the filter channels with a triangular cross section comprising crystal faces etched at a relatively slow etching speed and a common intersecting crystal face, the filter can be obtained easily and with high precision.

As can be appreciated by one of ordinary skill in the art, while the device in this example is fabricated with single crystal silicon as substrate 1, Agermanium, single crystal silicon oxide (quartz), or other materials enabling anisotropic etching may be used. Single crystal silicon is readily obtainable as a semiconductor material, and quartz and germanium are available as high purity crystals enabling high precision processing.

A method for mass manufacturing ink jet heads is described below. This method batch processes plural groups of ink passages to a single silicon wafer of substrate 1 using a single pattern; similarly batch processes the second and third substrates with the positions and number of pattern elements coordinated with substrate 1; laminating these three substrates together; and then slicing the laminated wafers into plural ink jet heads.

Figure 14:
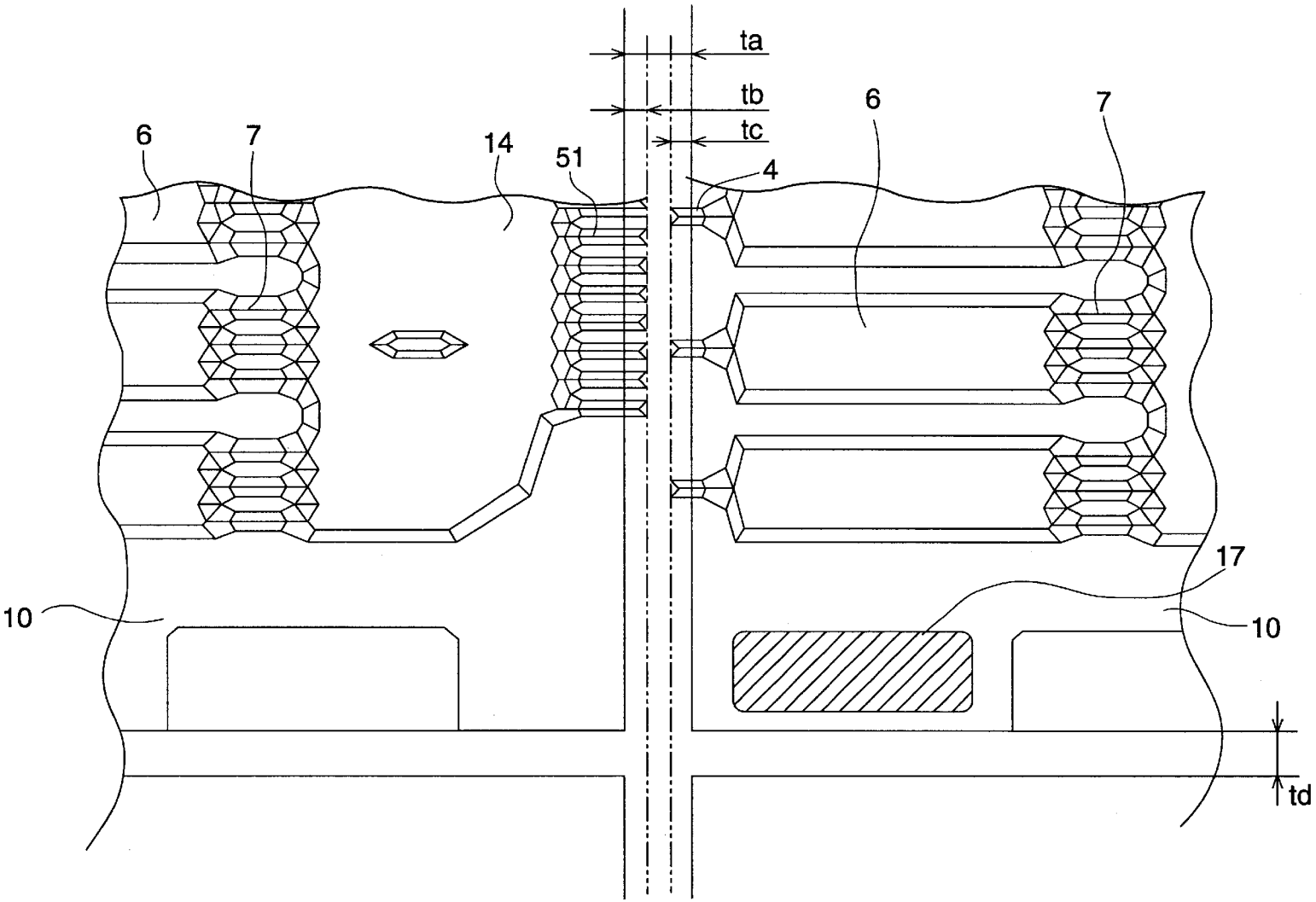
FIG. 14 is a pattern diagram showing the cutting margins between plural ink passage patterns formed by anisotropic etching to a silicon substrate.

FIG. 14 shows the pattern of the places sliced to separate the individual ink jet heads after anisotropic etching of plural sets of ink passage patterns to a single silicon wafer. This slicing pattern is formed as part of the line pattern described above. The patterns for ink jet heads 10 separated by slicing are formed with the nozzles 4 and filter 51 mutually opposed. After bonding substrates 2 and 3 to substrate 1, the slicing margin $t_a$ of adjacent patterns is removed to separate the individual ink jet heads. The filter 51 pattern overlaps the slicing margin $t_a$ by margin $t_b$, and the nozzle 4 pattern overlaps the slicing margin $t_a$ by margin $t_c$.

For example, when the ink jet heads are sliced apart and separated in the dicing process, a grinding stone slightly narrower than the slicing margin ta is used to cut apart the ink jet heads referenced to the filter 51 side. The nozzles 4 are then polished, and post-processed for water repellence, etc.

This manufacturing method enables the batch production of plural ink jet heads, and makes it possible to easily manufacture ink jet heads at low cost. Because the cross-sectional area of the filter 51 openings is the smallest part of the head externally exposed, it is possible to prevent the penetration of foreign particulate from the manufacturing process into the ink jet head by cutting the filter channels to form the heads. This also reduces manufacturing defects, and thus increases ink jet head production yield.

Various means of cutting the ink jet heads apart can be used, including: abrasive grinding by dicing, scribing and then breaking, laser scribing, and cutting by a water jet. More specifically, abrasive grinding by dicing enables cutting with relatively good precision. Dicing also makes it possible to assure the length of filter 51 with good precision. Scribing and then breaking is the easiest and quickest method of cutting the ink jet heads apart, and is suited to mass production. Laser scribing does not produce chips from cutting, and has the lowest probability of causing clogging as a result of the manufacturing process. Cutting by a water jet is the most resistant to side effects from heat.

It is to be noted that whichever cutting method is used there is no difference in the obtained benefits because the filter 51 are formed by first etching filter channels, bonding the substrates together, and then cutting to expose the opening of the filter channels forming the filter.

By means of the invention thus described, it is possible to prevent clogging of the ink passage due to the penetration of foreign particulate, and it is thereby possible to obtain a high reliability ink jet head with no missing dots. It is also possible to provide a high print quality ink jet head and ink jet recording apparatus because there is no pressure interference between ink passages, thereby eliminating ink supply deficiencies and enabling consistent ink ejecting.

Manufacturing is also simple, and a low cost, dimensionally precise, high quality ink jet head can be obtained.

Figure 15:
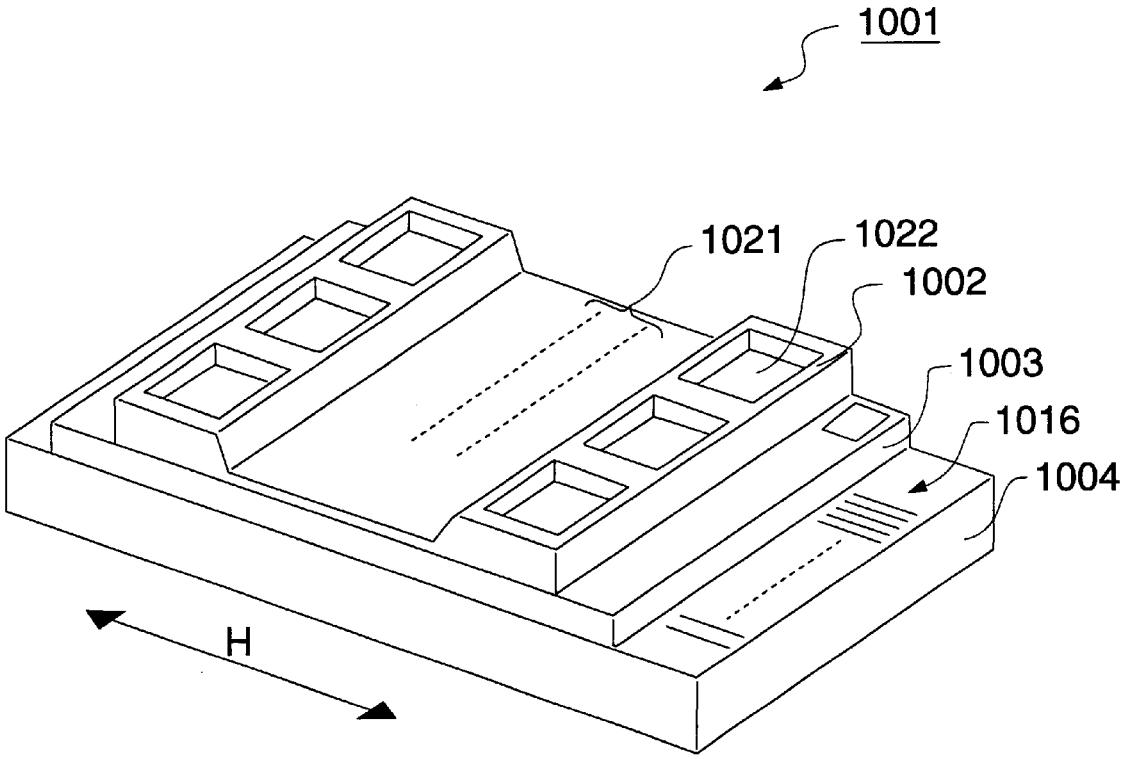
FIG. 15 is a perspective view of an ink jet head according to a preferred embodiment of the present invention.
Figure 16:
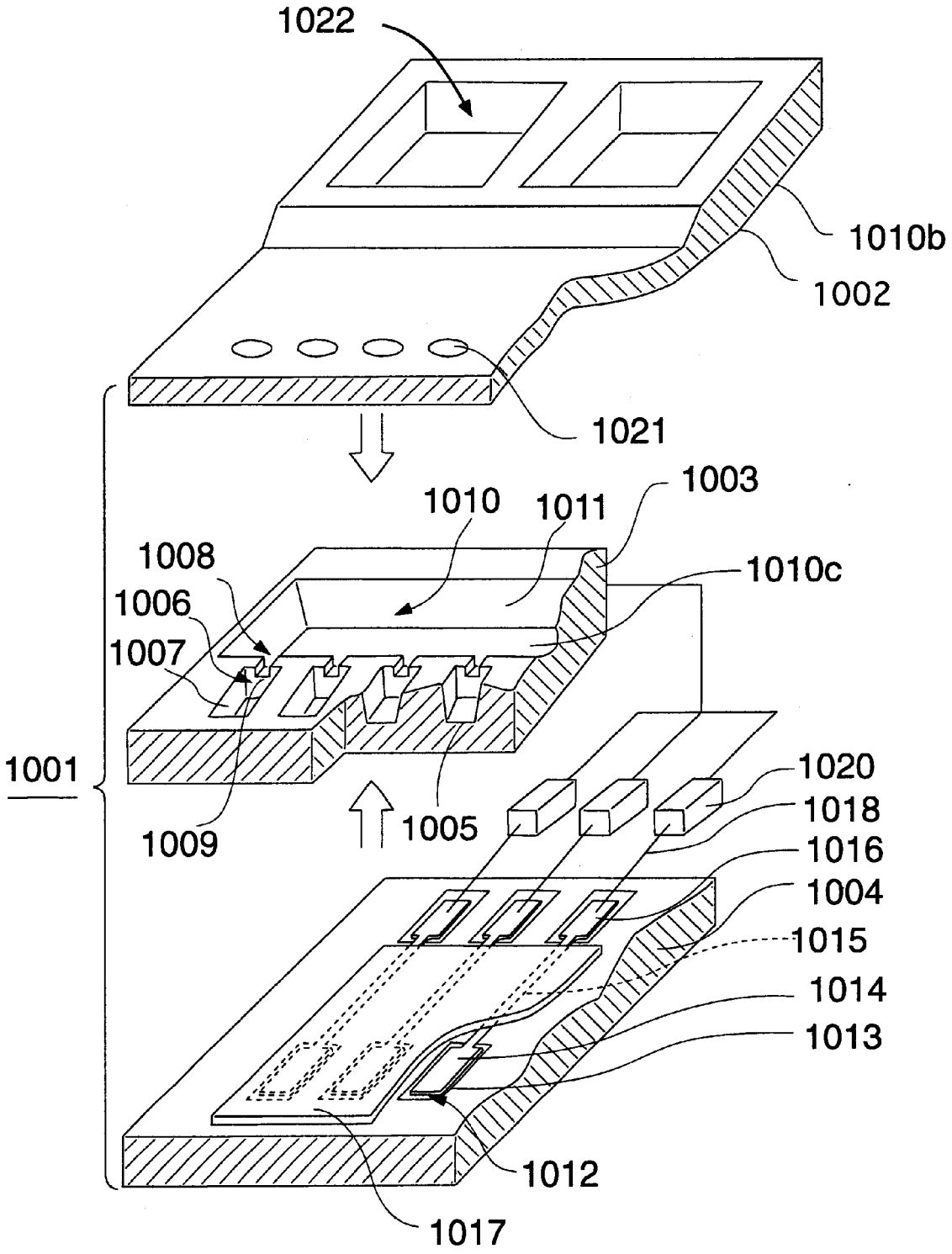
FIG. 16 is a partially exploded perspective view of the ink jet head shown in FIG. 15.
Figure 17:
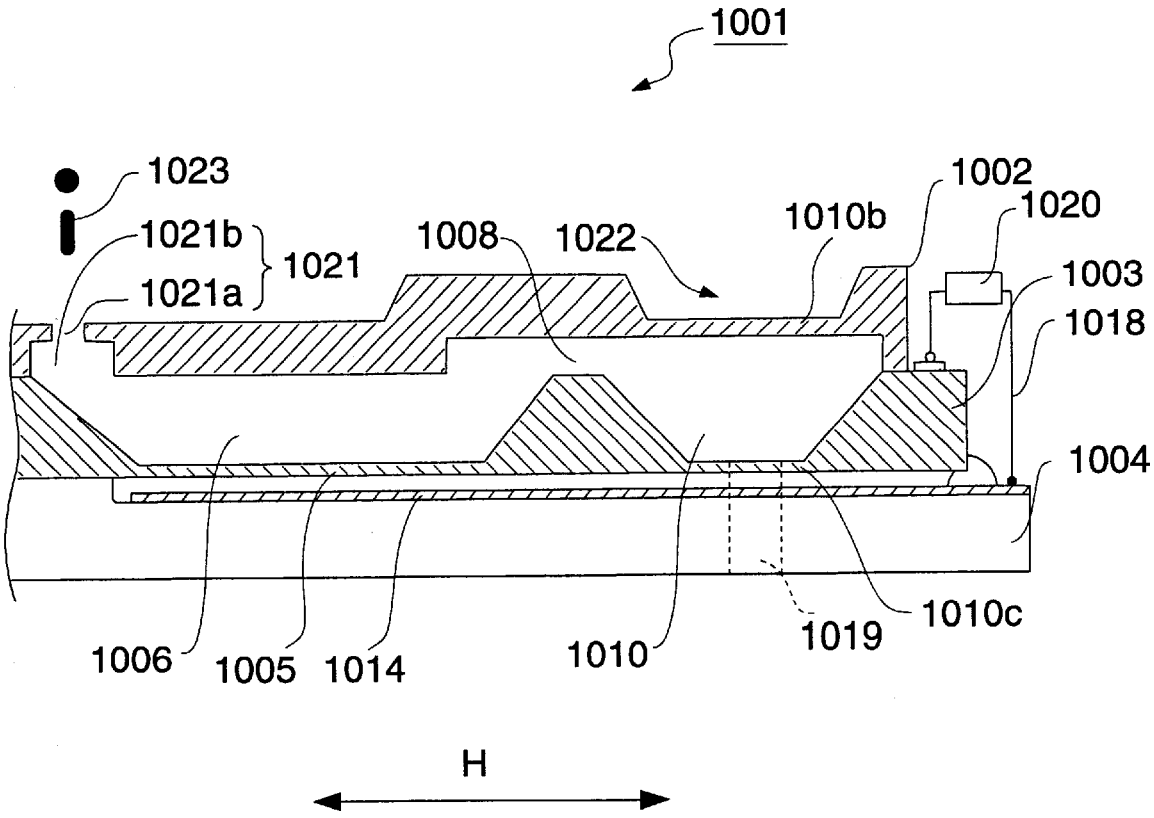
FIG. 17 is a partial cross sectional view of the ink jet head shown in FIG. 15 taken in the horizontal direction H.

FIG. 15 is a perspective view showing the appearance of an ink jet head according to the present invention. FIG. 16 is a partially exploded perspective view of the ink jet head shown in FIG. 15, and FIG. 17 is a partial cross sectional view of the ink jet head through the horizontal direction H as indicated in FIG. 15. As will be appreciated by one of ordinary skill in the art, the ink jet head 1001 of the invention may be implemented in an electrostatic drive, face ejection type ink jet head whereby the ink is ejected from nozzles provided on the top surface of the substrate.

As will be evident from the figures, ink jet head 1001 is a laminated construction of three substrates, that is, a nozzle plate (first substrate) 1002, a cavity plate (second substrate) 1003, and a glass substrate 1004 bonded together with the cavity plate 1003 between the other two substrates.

The cavity plate 1003 is, for example, a silicon wafer having a plurality of recesses 1007, orifice channels 1009, and recesses 1011 etched into a surface of the cavity plate. The recesses 1007 become ejection chambers 1006 with the bottom wall of each recess functioning as a diaphragm 1005, when assembled with nozzle plate 1002 and glass substrate 1004. The relatively large recess 1011 becomes an ink reservoir 1010 from which ink is supplied to each of ejection chambers 1006. The orifice channels 1009 become orifices 1008, which are formed at the back of recesses 1007 between ejection chambers 1006 and ink reservoir 1010.

The bottom surface of cavity plate 1003, that is, the surface opposite the above etched surface, is smoothed by mirror polishing, forming a mounting surface for adhesion to glass substrate 1004.

Nozzle plate 1002 is bonded to the top surface, that is, the etched surface, of the cavity plate 1003. A plurality of nozzles 1021, each in communication with a corresponding ejection chamber 1006, is formed in a part of the nozzle plate 1002 forming the top wall of ejection chambers 1006. Nozzles 1021 have a stepped cross section as shown in FIG. 17, thus forming a circular nozzle part 1021*a* with a small sectional area at the outside side in the ink droplet ejection direction, and a circular nozzle part 1021*b* with a large sectional area behind (on the inside side of) the small nozzle part 1021*a*.

Laminating nozzle plate 1002 and cavity plate 1003 together thus forms ejection chambers 1006, orifices 1008, and ink reservoir 1010 appropriately separated from each other in the horizontal direction between plates 1002 and 1003.

Glass substrate 1004 is bonded to the bottom surface of cavity plate 1003. An ink supply opening 1019 is formed in the wall of glass substrate 1004 at a position corresponding to the bottom of ink reservoir 1010, and extends to ink reservoir 1010. An external ink source, such as an ink tank (not shown), is connected to ink supply opening 1019 by a connector pipe. Ink can thus be supplied from the ink source through ink supply opening 1019 to ink reservoir 1010.

A plurality of recesses 1013 is also formed in glass substrate 1004 at positions corresponding to each of diaphragms 1005. Recesses 1013 form vibration chambers 1012. An individual electrode 1014 is formed in the bottom of recesses 1013 opposite corresponding diaphragm 1005. Individual electrodes 1014 are connected by a lead 1015 to a matching terminal 1016. Individual electrodes 1014 and leads 1015, but not terminals 1016, are covered by a dielectric film 1017. A lead wire 1018 is bonded to each of terminals 1016.

Diaphragms 1005 are also the bottom of each ejection chamber 1006 formed in nozzle plate 1002, and operate as a common electrode. A driver circuit 1020 is connected between this common electrode and terminal 1016 of each individual electrode 1014. When a voltage is applied by driver 1020 to an individual electrode 1014, that individual electrode 1014 and opposing diaphragm 1005 vibrate as a result of electrostatic force. This produces a pressure change in the ejection chamber 1006, and causes an ink droplet 1023 to be ejected from nozzles 1021. It is well within the scope of one of ordinary skill in the art to develop a driver circuit in accordance with the appropriate required voltages.

For example, if a positive voltage pulse by driver circuit 1020 is applied to charge the surface of individual electrode 1014 with a positive potential, the bottom of opposing diaphragm 1005 is negatively charged. Electrostatic force thus pulls on diaphragm 1005 and causes it to deflect downward as seen in the figures. This causes ink to be supplied from ink reservoir 1010 through orifices 1008 to ejection chamber 1006. When the pulse voltage applied to individual electrode 1014 is then turned off, diaphragm 1005 is permitted to return to the original position, thus creating a sudden increase in the internal pressure of ejection chamber 1006 and causing an ink droplet 1023 to be ejected from nozzle 1021.

It should be noted that the ink used in ink jet head 1001 is prepared by dissolving or dispersing ethylene glycol or some other surfactant together with dye or pigment in a primary medium of water, alcohol, toluene, or other material. A hot melt ink can also be used if a heater is additionally disposed to the ink jet head.

It should be further noted that ink reservoir 1010 formed between nozzle plate 1002 and cavity plate 1003 comprises a mutually opposing first wall part 1010*b* and a second wall part 1010*c*, each extending in the horizontal direction H. A total of six thin-wall pressure change buffers 1022 is formed in first wall 1010*b* at a point near orifice 1008 to buffer pressure changes in the ink reservoir 1010.

Figure 18:
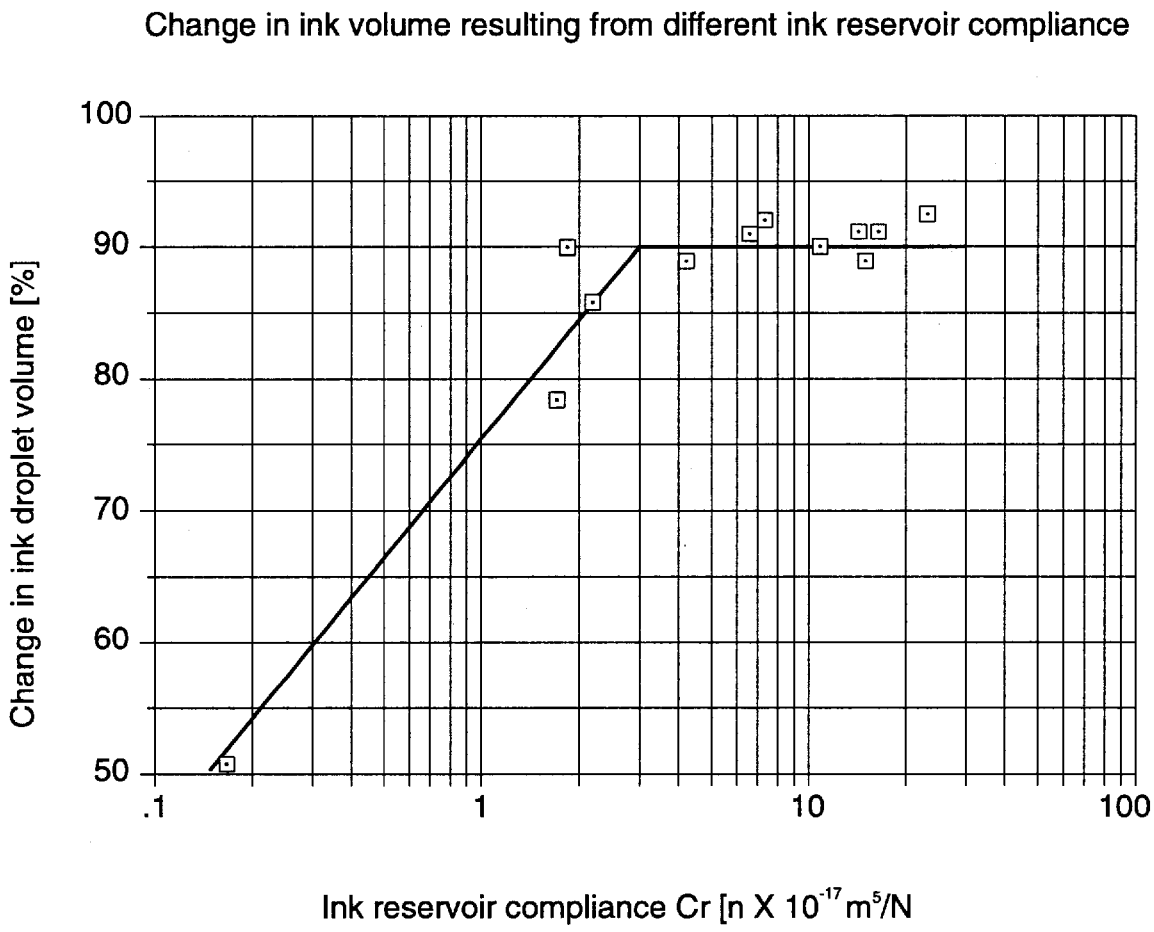
FIG. 18 is a graph showing the correlation between the compliance of the pressure change buffer and the ink droplet volume.
Figure 23A:
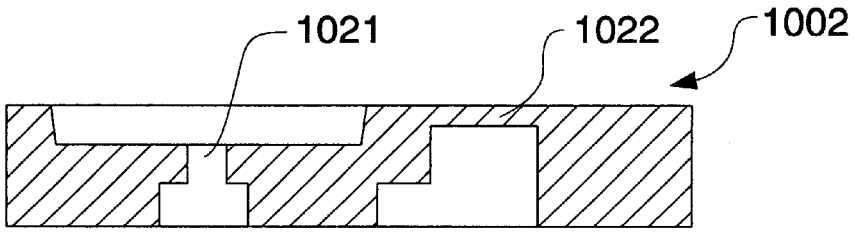
FIGS. 23A–23D are a sectional views of a nozzle plate according to an alternative version of the ink jet head shown in FIG. 15.
Figure 23B:
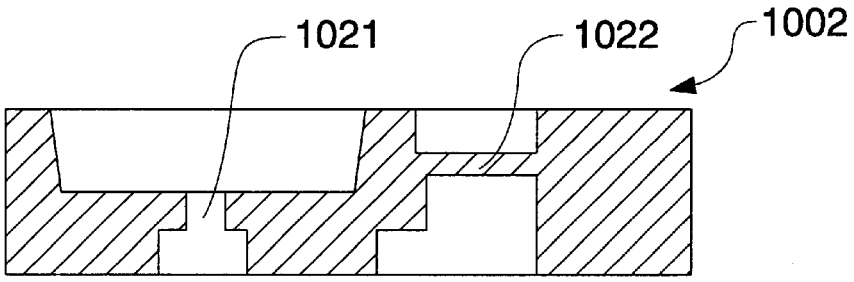
Figure 23C:
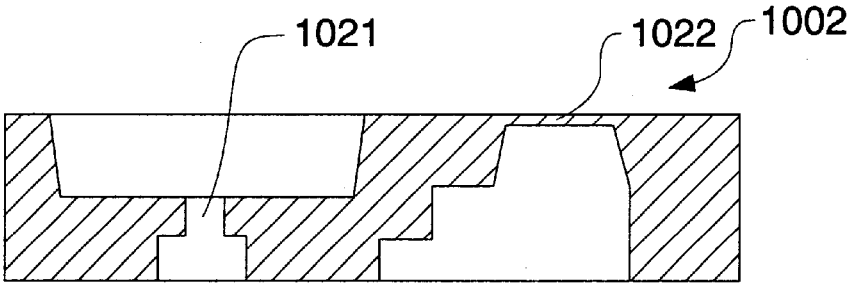
Figure 23D:
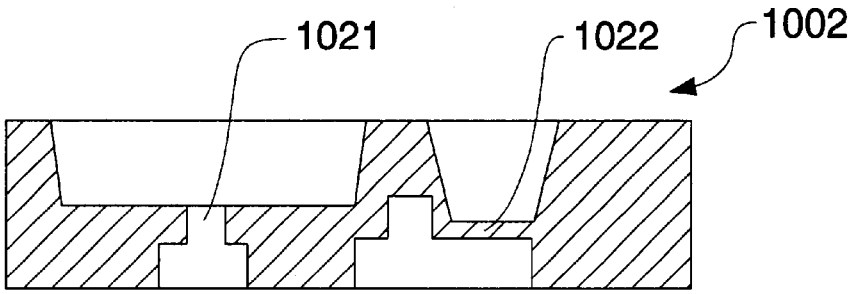

FIG. 18 is a graph illustrating the relationship between the rate of change in ink droplet volume and the compliance Cr of the pressure change buffer 1022. As will be known from this graph, the change in ink droplet volume can be maintained at approximately 75% when the compliance Cr of pressure change buffer 1022 is $1\times10^{-17}$ $m^5/N$, and the required ink ejection characteristics can be sufficiently assured. The thickness and area of the pressure change buffer 1022 are therefore adjusted in ink jet head 1001 according to the present invention to ensure that the compliance Cr is $1\times10^{-17}$ $m^5/N$ or greater.

When pressure change buffer 1022 is thus formed, it can sufficiently alleviate pressure changes in the ink reservoir 1010, and can thereby suppress pressure interference between the nozzles. It should be further noted that in order to substantially eliminate any change in the ink droplet volume and pressure interference between the nozzles, the compliance Cr of pressure change buffer 1022 is preferably $3\times10^{-17}$ $m^5/N$.

As described above, pressure change buffer 1022 is formed in first wall 1010*b* forming part of ink reservoir 1010 and extending in a horizontal direction H in ink jet head 1001 according to the present invention. It is therefore not necessary to provide an ink distributor or similar separate member as taught in Japanese Examined Patent Publication (kokoku) HEI2-59769, and pressure interference between nozzles can thus be prevented without incurring an increase in size. Pressure change buffer 1022 for pressure interference prevention can also be easily formed with the desired characteristics because pressure change buffer 1022 can be formed with a large area.

It should be further noted that first wall 1010*b* in which pressure change buffer 1022 is formed in ink jet head 1001 according to the present invention is a part of the wall near orifice 1008. As a result, ejection pressure transmitted from ejection chamber 1006 through orifice 1008 can be absorbed by the pressure change buffer 1022 at the point it reaches ink reservoir 1010. Pressure interference between nozzles can thus be effectively prevented because the pressure can be buffered before it reaches ink reservoir 1010.

An exemplary method of manufacturing nozzle plate 1002 in a ink jet head 1001 according to the present invention is illustrated in: FIGS. 19A–19C, 20D–20D, 21A–21D, and 22 described below.

Step 1: First Thermal Oxidation Film Formation

Referring first to FIG. 19A, a 180 $\mu$m thick silicon wafer 1030 is prepared and thermally oxidized to form on the surface thereof a $SiO_2$ resist film 1031 at least 1.2 $\mu$m thick.

Step 2: First $SiO_2$ Resist Film Patterning Process

As shown in FIG. 19B, patterns 1032*b* and 1033 are then formed by partially etching the $SiO_2$ resist film 1031 covering the surface 1030*a* of the silicon wafer 1030. These patterns 1032*b* and 1033 form large nozzle part 1021*b* of nozzles 1021, orifices 1008, and first wall 1010*b* of ink reservoir 1010. A typical etching solution is ammonia fluoride (HF: $NH_4F$=880 ml:5610 ml).

Step 3: Second $SiO_2$ Resist Film Patterning Process

As shown in FIG. 19C, pattern 1032*a* for forming small nozzle part 1021*a* of nozzle 1021 is formed in the partially etched pattern 1032*b* part of $Si0_2$ resist film 1031. More specifically, the partially etched area is etched again to expose the surface of the silicon wafer and form pattern 1032*a*. The etching solution used in this case is typically the same ammonia fluoride solution.

Step 4: First Dry Etching Process

After twice patterning $SiO_2$ resist film 1031 as described above, anistropic dry etching using ICP discharge is applied to silicon wafer 1030 as shown in FIG. 20A. This process etches silicon wafer 1030 perpendicularly to the surface thereof in a pattern corresponding to pattern 1032*a* formed in step 3, and thus forms channels 1034 of a specific depth. The etching gases used for this process are typically $CF_4$ and $SF_6$, which are used in succession. Note that $CF_4$ is used to protect the side walls of the channels so that the side walls are not etched; $SF_6$ is used to promote etching perpendicularly to the silicon wafer surface.

After thus forming channels 1034, $SiO_2$ resist film 1031 is etched at an appropriate etching rate using a hydrogen fluoride solution to completely remove patterns 1032*b* and 1033. This completely removes patterns 1032*b* and 1033 formed in step 2 and exposes the surface of silicon wafer 1030 as shown in FIG. 20B.

Step 5: Second Dry Etching Process

Anistropic dry etching using ICP discharge is then repeated as shown in FIG. 20C. This results in the exposed surface area of the silicon wafer being etched perpendicularly in the thickness direction of the wafer with the cross sectional shape of the wafer being maintained. The etching gases used in this case are the same as in step 4. This etching step forms nozzle grooves 1036 with a cross sectional shape corresponding to stepped nozzles 1021; and grooves 1037 with a cross sectional shape corresponding to orifices 1008 and first wall 1010*b* of ink reservoir 1010.

After this dry etching, the remaining $SiO_2$ resist film 1031 is completely removed by washing with a hydrogen fluoride solution (for example, HF:$H_2O$=1:5 vol, 25° C.). The result of this step is shown in FIG. 20D.

Step 6: Second Thermal Oxidation Film Formation

Referring to FIG. 21A, the silicon wafer 1030 is again thermally oxidized to form on the surface thereof a $SiO_2$ resist film 1038, typically approximately 1.2 $\mu$m thick.

Step 7: Third $SiO_2$ Resist Film Patterning Process

As shown in FIG. 21B, patterns 1040 and 1041 are formed by etching $SiO_2$ resist film 1038 on surface 1030*b* of silicon wafer 1030 opposite that etched above. Pattern 1040 corresponds to the recesses in which nozzles 1021 are opened, and pattern 1041 corresponds to pressure change buffer 1022. The etching solution used in this case can be the same as that in step 2 above.

Step 8: Wet Etching Process

As shown in FIG. 21C, silicon wafer 1030 is then immersed in an etching solution for anistropic wet etching of the exposed part of silicon wafer 1030, forming channel 1042 and opening nozzle 1021 completely through the wafer. Channel 1043 is also formed, thus forming pressure change buffer 1022 to a specific depth. The etching solution used in this case is typically a 2 wt % potassium hydride solution at 80° C.

After etching, the $SiO_2$ resist film 1038 is completely removed using hydrogen fluoride, again exposing the surface of the silicon wafer 1030 as shown in FIG. 21D.

Referring to FIG. 22, the silicon wafer is then again thermally oxidized to again form a $SiO_2$ film to improve the ink resistance of the silicon wafer and the water repellency of the nozzle surface.

Resulting nozzle plate 1002 is then bonded to Cavity plate 1003, thus forming ejection chambers 1006, orifices 1008, and ink reservoir 1008 arranged horizontally H to the surface.

Other embodiments

It will be obvious to one of ordinary skill in the art that the configuration of nozzle plate 1002 shall not be limited to that described above, and can be configured as shown, for example, in FIGS. 23A to 23D. What is important is that the area and thickness of pressure change buffer 1022, and the volume of the ink reservoir 1010, be considered to assure the desired operating characteristics as described above.

Figure 24A:
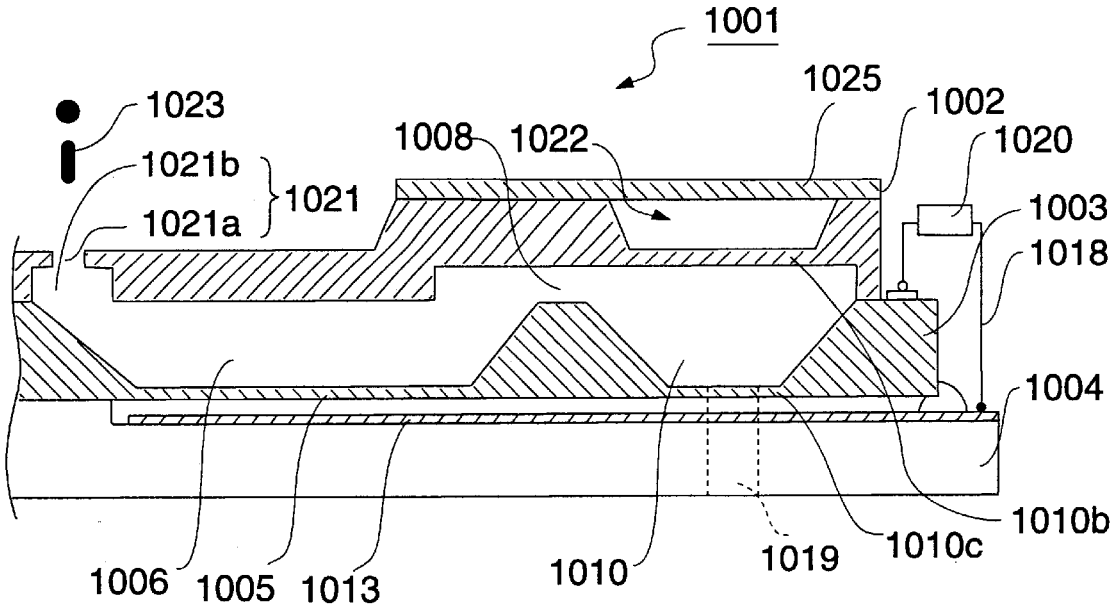
FIGS. 24A and 24B are sectional views showing a further version of an ink jet head comprising a protective cover on the nozzle plate for protecting the pressure change buffering means.
Figure 24B:
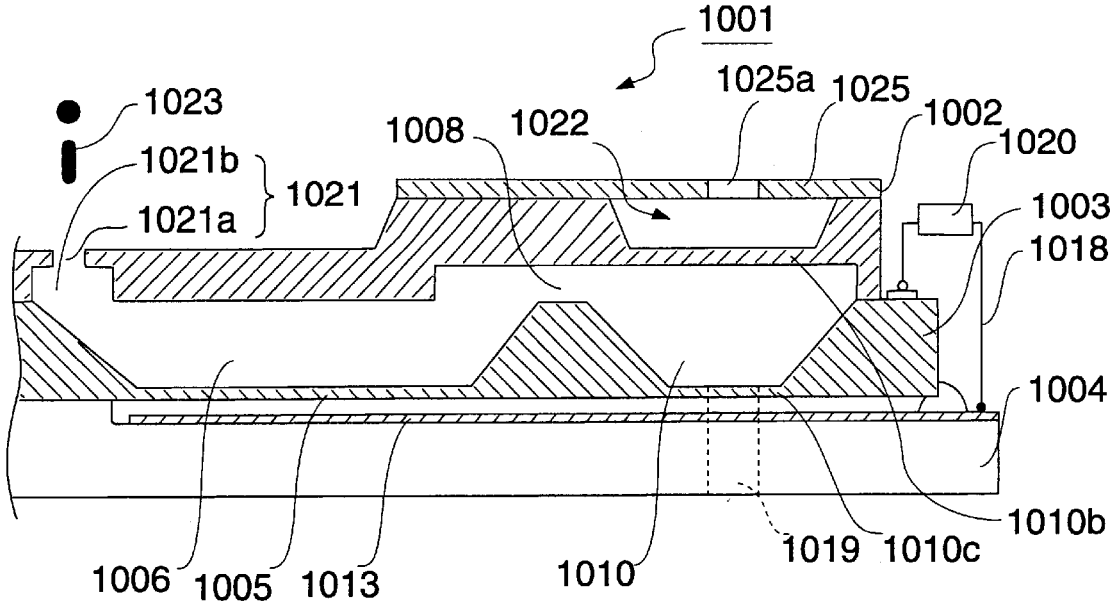

Pressure change buffer 1022 is also preferably covered by a protective cover 1025 as shown in FIG. 24A to protect the otherwise exposed pressure change buffer 1022. However, if the pressure change buffer 1022 is completely covered by a protect cover 1025 as shown in FIG. 24A, the pressure change buffer 1022 becomes sealed. This can adversely affect vibration of the pressure change buffer 1022. It is therefore further preferable to provide a ventilation opening 1025a in protective cover 1025, as shown in FIG. 24B.

It will be also obvious that ink jet head 1001 according to the present invention as described above shall not be limited to a face ejection type ink jet head whereby ink droplets 1023 are ejected from the top surface of nozzle plate 1002, and can also be applied to edge ejection type ink jet heads whereby ink droplets 1023 are ejected from the side of nozzle plate 1002.

It will also be obvious that the ink jet head according to the present invention can also be used with ink jet heads of the type that expel ink droplets using pressure from generated air bubbles, and with ink jet heads that are operated with piezoelectric elements.

As will be known from the above description of the invention, an ink jet head in which ejection chambers, nozzles, and an ink reservoir are formed in a horizontal arrangement by appropriately patterning a plurality of laminated substrates also has a pressure buffer for buffering pressure changes in the ink reservoir formed in a part of the wall forming the ink reservoir near the nozzles.

It is therefore possible to provide an ink jet head capable of preventing pressure interference between nozzles without increasing the size of the ink jet head because it is not necessary to provide a separate pressure buffering means such as an ink distributor.

In addition, because a pressure change buffer with a large area can be formed, an ink jet head can be provided in which a pressure change buffering means for preventing pressure interference can be easily formed with the desired characteristics.

In addition, because the pressure change buffer is formed in a wall near the nozzles, ejection pressure transmitted from the ejection chamber can be buffered by the pressure change buffering means immediately upon reaching the ink reservoir.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An ink jet head for ejecting ink droplets, said ink jet head comprising:

a common ink chamber having at least one inflexible wall and having a flexible wall forming a buffer, said common ink chamber being made of a substantially single construction material such that said flexible wall and said inflexible wall are made of the substantially same construction material;

a plurality of nozzles;

a plurality of ink paths, each one of said plurality of ink paths connecting a corresponding one of said plurality of nozzles to said common ink chamber; and a plurality of pressure generators, each of said plurality of pressure generators being disposed in a respective one of said plurality of ink paths and selectively driven for ejecting an ink droplet from a corresponding one of said plurality of nozzles;

wherein said buffer buffers pressure change in said common ink chamber.

2. The ink jet head of claim 1, wherein said plurality of nozzles and said plurality of ink paths are made of the substantially same construction material as said common ink chamber.

3. An ink jet for ejecting ink droplets, said ink jet head comprising:

a common ink chamber having at least one inflexible wall and having a flexible wall forming a buffer, said common ink chamber being made of a substantially single construction material such that said flexible wall and said inflexible wall are made of the substantially same construction material;

a plurality of nozzles;

a plurality of ink paths, each one of said plurality of ink paths connecting a corresponding one of said plurality of nozzles to said common ink chamber, wherein said plurality of nozzles and said plurality of ink paths are made of the substantially same construction material as said common ink chamber; and a plurality of pressure generators, each of said plurality of pressure generators being disposed, in a respective one of said plurality of ink paths and selectively driven for ejecting an ink droplet from a corresponding one of said plurality of nozzles, wherein at least a part of each of said pressure generators is made of the substantially same construction material as said common ink chamber;

wherein said buffer buffers pressure change in said common ink chamber.

4. The ink jet of claim 1, where said construction material has a substantially uniform crystalline structure.

5. An ink jet head for ejecting ink droplets, said ink jet head comprising:

a first substrate having a plurality of nozzles arranged therein;

a second substrate having a recess, a bottom of said recess forming a flexible wall and its interior other than said bottom of said recess forming a plurality of inflexible walls, said flexible wall being integrally formed with said inflexible walls, wherein said first substrate is arranged on said second substrate such that said recess forms a common ink chamber and a plurality of ink paths, wherein each one of said plurality of ink paths connects a corresponding one of said plurality of nozzles to said common ink chamber, and wherein said flexible wall forms a buffer with said common ink chamber; and a plurality of pressure generators, each of said plurality of pressure generators being disposed in a respective one of said plurality of ink paths and selectively driven for ejecting an ink droplet from a corresponding one of said plurality of nozzles;

wherein said buffer buffers pressure change in said common ink chamber.

6. The ink jet of claim 5, wherein said first and second substrates are made of a substantially similar construction material having a crystalline structure.

7. An ink jet head for ejecting ink droplets, said ink jet head comprising:

a generally inflexible first substrate having a predefined flexible region integrally formed with an inflexible region, said flexible region forming a flexible wall, said first substrate further having a plurality of nozzles arranged in said inflexible region;

a second substrate having a recess, wherein said first substrate is arranged on said second substrate such that said recess forms a common ink chamber and a plurality of ink paths, wherein each one of said plurality of ink paths connects a corresponding one of said plurality of nozzles to said common ink chamber, and wherein said flexible wall forms a buffer with said common ink chamber; and a plurality of pressure generators, each of said plurality of pressure generators being disposed in a respective one of said plurality of ink paths and selectively driven for ejecting an ink droplet from a corresponding one of said plurality of nozzles;

wherein said buffer buffers pressure change in said common ink chamber.

8. The ink jet head according to claim 1, 5, or 7, further comprising a protective cover covering said flexible wall.

9. The ink jet head according to claim 8, further comprising a ventilation hole arranged in said protective cover.

10. The ink jet head according to claim 1, 5 or 7, wherein said flexible wall is formed so that compliance of the common ink chamber is at least $1\times10^{-17}$ $m^5/N$.

11. An ink jet head for ejecting ink droplets, said ink jet head comprising:

a common ink chamber having a flexible wall forming a buffer;

a plurality of nozzles;

a plurality of ink paths, each one of said plurality of ink paths connecting a corresponding one of said plurality of nozzles to said common ink chamber; and a plurality of pressure generators, each of said plurality of pressure generators being disposed in a respective one of said plurality of ink paths and selectively driven for ejecting an ink droplet from a corresponding one of said plurality of nozzles;

wherein said buffer buffers pressure change in said common ink chamber;

wherein said flexible wall is formed so that compliance of the common ink chamber is at least $3\times10^{-17}$ $m^5/N$.

12. The ink jet head according to claim 1, 5 or 7, wherein each of said pressure generators comprise:

a diaphragm disposed in part of a corresponding one of said plurality of ink paths; and a piezoelectric element in communication with said diaphragm.

13. The ink jet head according to claim 1, 5 or 7, wherein each of said pressure generators comprises a heating element disposed in part of a corresponding one of said plurality of ink paths.

14. The ink jet head according to claim 1, 5 or 7, further comprising an ink supply opening for supplying ink to said common ink chamber.

15. The ink jet head according to claim 14, further comprising a filter provided in said ink supply opening.

16. The ink jet head according to claim 1, 5 or 7, wherein each of said pressure generators comprises an electrostatic actuator.

17. The ink jet head of claim 7, wherein said flexible region is defined by a cavity in said first substrate such that the base of said cavity constitutes said flexible wall.

18. The ink jet head of claim 17, wherein said flexible wall is disposed over said common ink chamber.

19. The ink jet head of claim 7, wherein said first and second substrates are made of substantially similar construction material having a uniform structure.

20. The ink jet head of claim 1, 6, or 19, wherein said construction material is an anisotropic crystalline substrate.

21. An ink jet head for ejecting ink droplets, said ink jet head comprising:

a generally inflexible first substrate having a predefined flexible region integrally formed with an inflexible region, said flexible region forming a flexible wall, said first substrate further having a plurality of nozzles arranged in said inflexible region;

a second substrate having a recess, wherein said first substrate is arranged on said second substrate such that said recess forms a common ink chamber and a plurality of ink paths, wherein each one of said plurality of ink paths connects a corresponding one of said plurality of nozzles to said common ink chamber, and wherein said flexible wall forms a buffer with said common ink chamber; and a plurality of pressure generators, each of said of plurality pressure generators being disposed in a respective one of said plurality of ink paths and selectively driven for ejecting an ink droplet from a corresponding one of said plurality of nozzles;

wherein said buffer buffers pressure change in said common ink chamber and wherein said common ink chamber further has a second flexible wall opposite the flexible wall that forms a buffer.

22. The ink jet head of claim 21, wherein the flexible wall that forms a buffer is exposed to the atmosphere and said second flexible wall is not exposed to the atmosphere.

23. An ink jet printing apparatus comprising:

an ink jet head having:

a common ink chamber having a flexible wall;

an ink supply opening for supplying ink to said common ink chamber;

a plurality of nozzles;

a plurality of ink paths, each one of said plurality of ink paths connecting a corresponding one of said plurality of nozzles to said common ink chamber;

a plurality of pressure generators, each of said plurality of pressure generators being disposed in a respective one of said plurality of ink paths; and a drive circuit selectively driving at least one of said pressure generators to eject an ink droplet from a selected one of said plurality of nozzles wherein said common ink chamber, said plurality of nozzles, and said plurality of ink paths are constructed of an anisotropic crystalline material, and wherein said flexible wall is integrally formed with at least one of said common ink chamber and said nozzles.

24. A method for manufacturing an ink jet head comprising the steps of:

a. providing first and second substrates constructed of substantially the same material;

b. forming a plurality of nozzles in the first substrate;

c. forming a flexible wall on the first substrate;

d. forming a recess having a shape in the second substrate; and e. laminating the first substrate to the second substrate, wherein the shape is such that when the first substrate is laminated to the second, a plurality of ink paths and a common cavity are formed, wherein each one of the plurality of ink paths connects a corresponding one of the plurality of nozzles to the common ink chamber, and wherein the flexible wall is arranged as a portion of the common cavity to buffer pressure change in the common ink chamber.

25. A method for manufacturing an ink jet head comprising the steps of:

a. providing first and second substrates constructed of substantially the same material;

b. forming a plurality of nozzles in the first substrate;

c. forming a flexible wall on the second substrate;

d. forming a recess having a shape in the second substrate; and e. laminating the first substrate to the second substrate, wherein the shape is such that when the first substrate is laminated to the second, a plurality of ink paths and a common cavity are formed, wherein each one of the plurality of ink paths connects a corresponding one of the plurality of nozzles to the common ink chamber, and wherein the flexible wall is arranged as a portion of the common cavity to buffer pressure change in the common ink chamber.

26. A method according to claim 24 or 25, wherein in step c, the flexible wall is formed so that compliance of the common ink chamber is at least $1\times10^{-17}$ $m^5/N$.

27. The method of claim 24 or 25, wherein said material is an anisotropic crystalline substrate.

28. A method for manufacturing an ink jet head comprising the steps of:

a. providing first and second substrates;

b. forming a plurality of nozzles in the first substrate;

c. forming a flexible wall on the first substrate, said flexible wall being formed so that compliance of the common ink chamber is at least $3\times10^{-17}$ $m^5/N$;

d. forming a recess having a shape in the second substrate; and e. laminating the first substrate to the second substrate, wherein the shape is such that when the first substrate is laminated to the second, a plurality of ink paths and a common cavity are formed, wherein each one of the plurality of ink paths connects a corresponding one of the plurality of nozzles to the common ink chamber, and wherein the flexible wall is arranged as a portion of the common cavity to buffer pressure change in the common ink chamber.

29. An ink jet head for ejecting ink droplets, said ink jet head comprising:

a first substrate having a plurality of nozzles arranged in said first substrates;

a second substrate having a flexible wall and having a recess, wherein said first substrate is arranged on said second substrate such that said recess forms a common ink chamber and a plurality of ink paths, wherein each one of said plurality of ink paths connects a corresponding one of said plurality of nozzles to said common ink chamber, and wherein said flexible wall forms a buffer with said common ink chamber; and a plurality of pressure generators, each of said plurality of pressure generators being disposed in a respective one of said plurality of ink paths and selectively driven for ejecting an ink droplet from a corresponding one of said plurality of nozzles;

wherein said buffer buffers pressure change in said common ink chamber;

wherein said flexible wall is formed so that compliance of the common ink chamber is at least $3\times10^{-17}$ $m^5/N$.

30. An ink jet head for ejecting ink droplets, said ink jet head comprising:

a first substrate having a flexible wall and a plurality of nozzles arranged in said first substrates;

a second substrate having a recess, wherein said first substrate is arranged on said second substrate such that said recess forms a common ink chamber and a plurality of ink paths, wherein each one of said plurality of ink paths connects a corresponding one of said plurality of nozzles to said common ink chamber, and wherein said flexible wall forms a buffer with said common ink chamber; and a plurality of pressure generators, each of said plurality of pressure generators being disposed in a respective one of said plurality of ink paths and selectively driven for ejecting an ink droplet from a corresponding one of said plurality of nozzles;

wherein said buffer buffers pressure change in common ink chamber;

wherein said flexible wall is formed so that compliance of the common ink chamber is at least $3\times10^{-17}$ $m^5/N$.

31. A method for manufacturing an ink jet head comprising the steps of:

a. providing first and second substrates;

b. forming a plurality of nozzles in the first substrate;

c. forming a flexible wall on the second substrate, said flexible wall being formed so that compliance of the common ink chamber is at least $3\times10^{-17}$ $m^5/N$;

d. forming a recess having a shape in the second substrate; and e. laminating the first substrate to the second substrate, wherein the shape is such that when the first substrate is laminated to the second, a plurality of ink paths and a common cavity are formed, wherein each one of the plurality of ink paths connects a corresponding one of the plurality of nozzles to the common ink chamber, and wherein the flexible wall is arranged as a portion of the common cavity to buffer pressure change in the common ink chamber.

32. An ink jet head for ejecting ink droplets, said ink jet head comprising:

a first substrate having a plurality of nozzles arranged in said first substrates;

a second substrate having a first recess and a flexible wall integrally formed at a bottom of said first recess, said first substrate arranged on said second substrate such that said first recess forms a common ink chamber and a plurality of ink paths, each one of said plurality of ink paths connecting a corresponding one of said plurality of nozzles to said common ink chamber;

a plurality of pressure generators, each of said plurality of pressure generators being disposed in a respective one of said ink paths and selectively driven for ejecting an ink droplet from a corresponding one of said plurality of nozzles; and a third substrate having a second recess, said second substrate arranged on said third substrate such that said second recess forms a pressure buffer chamber, wherein said pressure buffer chamber is isolated from said common ink chamber by said flexible wall such that said flexible wall buffers pressure change in said common ink chamber.

33. The ink jet head of claim 32, wherein said pressure buffer chamber includes an oxide film on said flexible wall.

34. An ink jet head for ejecting ink droplets, said ink jet head comprising:

a generally inflexible first substrate having a predefined flexible region integrally formed with an inflexible region, said flexible region being within a first recess and forming flexible wall, said first substrate further having a plurality of nozzles arranged in said inflexible region;

a second substrate having a second recess, said first substrate arranged on said second substrate such that said second recess forms a common ink chamber and a plurality of ink paths, each one of said plurality of ink paths connecting a corresponding one of said plurality of nozzles to said common ink chamber;

a plurality of pressure generators, each of said plurality of pressure generators being disposed in a respective one of said ink paths and selectively driven for ejecting an ink droplet from a corresponding one of said plurality of nozzles; and a protective cover arranged on said first substrate such that said first recess forms a pressure change buffer, wherein said pressure change buffer is isolated from said common ink chamber by said flexible wall such that said flexible wall buffers pressure change in said common ink chamber.

35. The ink jet head according to claim 34, further comprising a ventilation hole arranged in said protective cover.

* * * * *

UNITED STATES PATENT AND TRADEMARK OFFICE

CERTIFICATE OF CORRECTION

PATENT NO. : 6,371,598 B1 
DATED : April 16, 2002
INVENTOR(S) : Masahiro Fujii et al.

It is certified that error appears in the above-identified patent and that said Letters Patent is hereby corrected as shown below:

Title page,
Item [30], Foreign Application Priority Data, change "October 9, 1998" to -- October 9, 1997 --;

Column 21,
Line 66, change "disposed," to -- disposed --; and

Column 26,
Line 1, change "change in common" to -- change in said common --

Signed and Sealed this

Nineteenth Day of November, 2002

*Attest:*

*Attesting Officer*

JAMES E. ROGAN
*Director of the United States Patent and Trademark Office*